US009322533B1

(12) United States Patent
Pearson et al.

(10) Patent No.: US 9,322,533 B1
(45) Date of Patent: Apr. 26, 2016

(54) LED SCONCE LIGHT FIXTURE APPARATUS

(71) Applicant: Tempo Industries, LLC, Irvine, CA (US)

(72) Inventors: Dennis Pearson, Foothill Ranch, CA (US); Michael D. Bremser, Seal Beach, CA (US); James Johnson, Lake Forest, CA (US); Jignesh Bhagat, Irvine, CA (US); Garry Tye, Ontario, CA (US)

(73) Assignee: Tempo Industries, LLC, Irvine, CA (US)

( * ) Notice: Subject to any disclaimer, the term of this patent is extended or adjusted under 35 U.S.C. 154(b) by 27 days.

(21) Appl. No.: 14/533,391

(22) Filed: Nov. 5, 2014

(51) Int. Cl.

| | |
|---|---|
| ***F21V 3/00*** | (2015.01) |
| ***F21V 5/00*** | (2015.01) |
| ***F21V 21/02*** | (2006.01) |
| ***F21S 8/00*** | (2006.01) |
| ***F21V 5/04*** | (2006.01) |
| ***F21V 23/06*** | (2006.01) |
| ***F21V 23/02*** | (2006.01) |
| ***F21V 15/01*** | (2006.01) |
| *F21Y 101/02* | (2006.01) |

(52) U.S. Cl.
CPC ..... *F21V 21/02* (2013.01); *F21S 8/036* (2013.01); *F21V 5/048* (2013.01); *F21V 15/01* (2013.01); *F21V 23/023* (2013.01); *F21V 23/06* (2013.01); *F21Y 2101/02* (2013.01)

(58) Field of Classification Search
CPC ..... F21V 21/02; F21V 5/048; F21V 23/06; F21V 23/023; F21V 15/01; F21V 21/047; F21S 8/036; F21S 8/03; F21S 8/00; F21Y 2101/02
USPC ..... 362/311.02, 432, 147, 370, 430
See application file for complete search history.

(56) References Cited

U.S. PATENT DOCUMENTS

| | | | | |
|---|---|---|---|---|
| 4,713,734 | A * | 12/1987 | DeKay | F21S 8/033 362/147 |
| 5,309,334 | A * | 5/1994 | Willison | A47G 7/044 362/122 |
| 7,726,840 | B2 | 6/2010 | Pearson et al. | |
| 8,002,426 | B2 | 8/2011 | Pearson et al. | |
| 8,061,870 | B2 * | 11/2011 | Pearson | F21S 8/033 362/145 |
| 8,398,276 | B2 | 3/2013 | Pearson et al. | |
| 8,672,508 | B2 | 3/2014 | Pearson | |
| 2004/0252506 | A1 * | 12/2004 | Patz | F21V 21/03 362/257 |
| 2005/0237732 | A1 * | 10/2005 | Lagman | A47B 57/40 362/132 |
| 2006/0083007 | A1 * | 4/2006 | Haugaard | F21S 8/033 362/382 |
| 2013/0271979 | A1 | 10/2013 | Pearson et al. | |
| 2013/0272000 | A1 | 10/2013 | Pearson et al. | |
| 2013/0279165 | A1 | 10/2013 | Pearson et al. | |
| 2013/0279179 | A1 | 10/2013 | Pearson et al. | |
| 2013/0279180 | A1 | 10/2013 | Pearson et al. | |

* cited by examiner

*Primary Examiner* — Anh Mai
*Assistant Examiner* — Glenn Zimmerman
(74) *Attorney, Agent, or Firm* — Lapple Ubell IP Law, LLP; Franklin Ubell

(57) ABSTRACT

A sconce light fixture and a wall mount bracket are configured such that the wall mount bracket may be attached to a wall and the sconce light fixture thereafter may be removably attached to the wall mount bracket in a manner which establishes a continuous electrical power path from the wall mount bracket to the sconce light fixture and LEDs mounted therein.

14 Claims, 27 Drawing Sheets

LED SCONCE LIGHT FIXTURE APPARATUS

BACKGROUND

1. Field

The subject disclosure relates to LED light fixtures and more particularly to an LED sconce light fixture, which is easily installable on a cooperating wall bracket component.

2. Related Art

Sconce light fixtures are known in the art, for example, as illustrated in U.S. Pat. No. 8,672,508, assigned to Tempo Industries, LLC.

SUMMARY

According to an illustrative embodiment, sconce light fixture apparatus is provided comprising a sconce light fixture and a separate wall mount bracket component. In one embodiment, the sconce light fixture has first and second hooks and first and second downwardly disposed electrical conductor pins mounted on a back side of a housing. The wall mount bracket component is configured to be attachable to a wall and has upper and lower junction boxes. The upper junction box has first and second tabs positioned on respective side surfaces thereof, while the lower junction box has first and second female electrical connector receptacles positioned in a top surface thereof.

In an illustrative embodiment, the first and second hooks and the first and second electrical conductor pins of the sconce light fixture and the first and second side tabs and the first and second female electrical connector receptacles of the wall mount bracket component are so shaped, dimensioned, and positioned that the sconce light fixture can be mounted to the wall mount bracket by sliding the first and second hooks respectively down over the first and second side tabs, while at the same time inserting the first and second electrical conductor pins respectively into the first and second female connector receptacles.

In one embodiment, the sconce light fixture further has a power supply cover located on a rear surface thereof and a power supply positioned within the cover. In this embodiment, the first and second hooks are mounted on a first end cap positioned adjacent a first end of said power supply cover, and the first and second conductor pins are mounted on a lower end cap positioned adjacent a lower end of the power supply cover. In one embodiment, the first and second end caps are fastened to a back surface of the housing and the second end cap is configured to retain the power supply cover in position on the back surface. In one embodiment, the power supply cover is rectangular in cross-section and the first and second end caps are shaped to close respective rectangular openings at upper and lower ends of the cover.

In one embodiment, the wall mount bracket may comprise a centrally located wire guide mounted between the upper and lower junction boxes and having a closed central conduit running between the upper and lower junction boxes. The upper junction box is configured to receive an electrical power cable and the conduit is configured to conduct the power cable to the lower junction box for attachment to the female connector receptacles.

DETAILED DESCRIPTION

Figure 1:
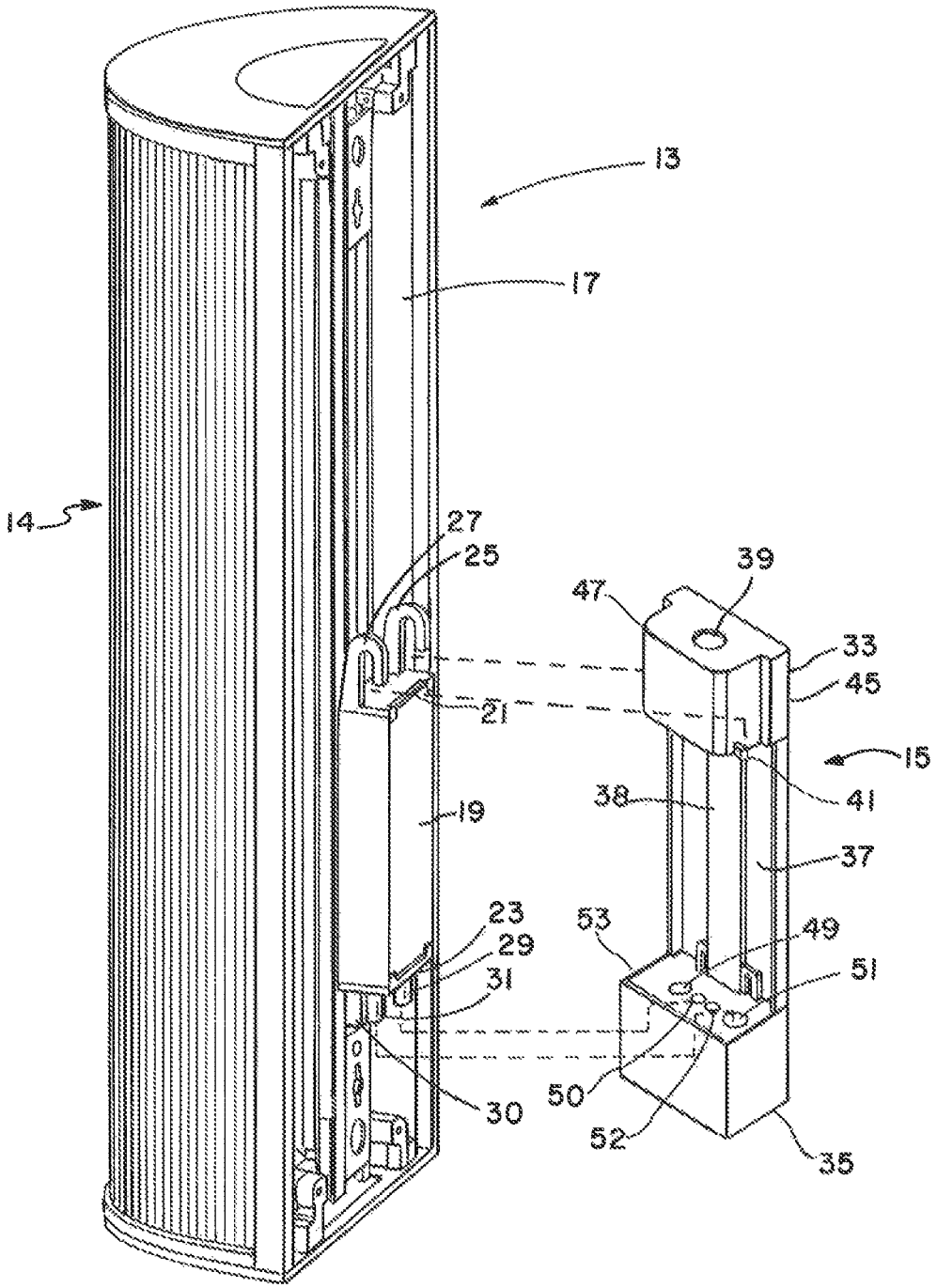
FIG. 1 is a side perspective view of a first illustrative embodiment.
Figure 2:
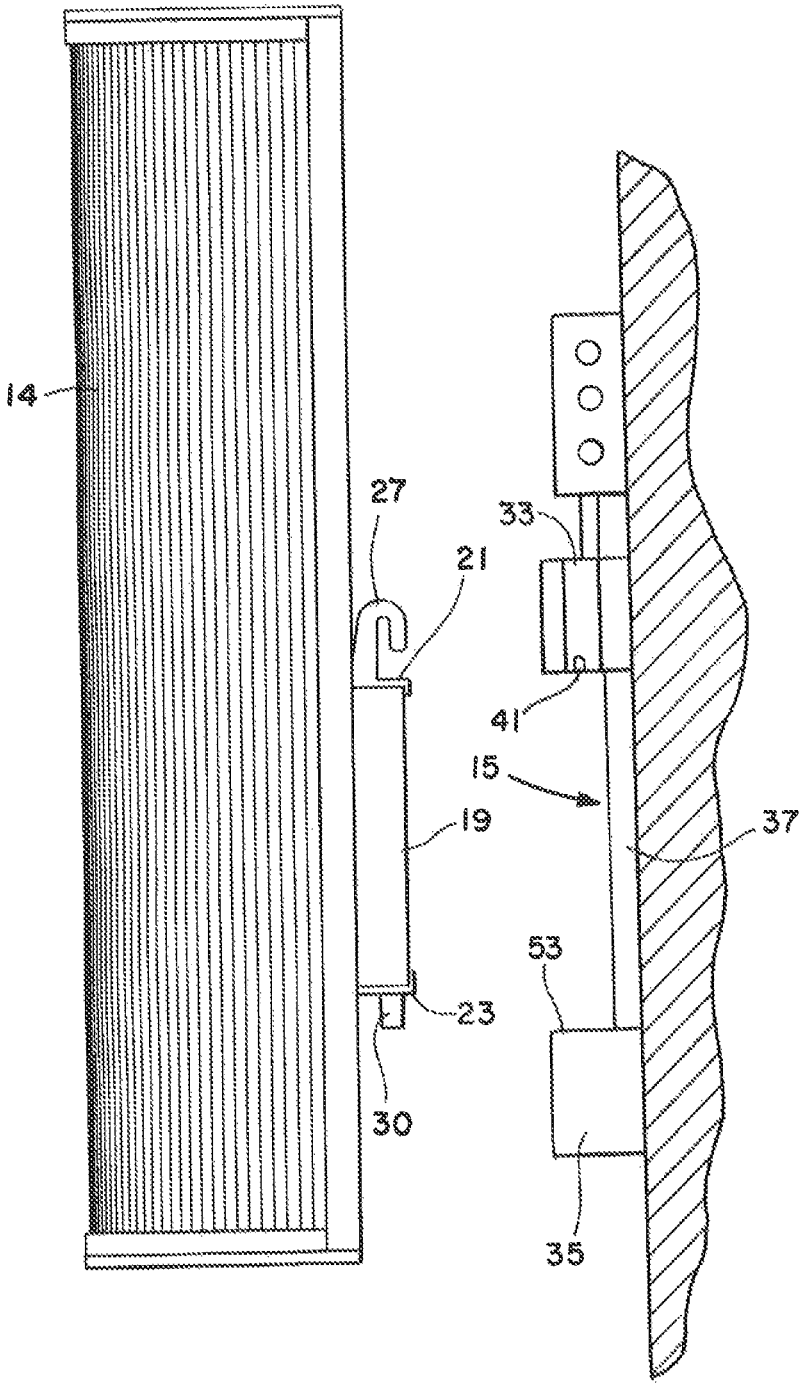
FIG. 2 is a side view of the embodiment of FIG. 1.

FIGS. 1-2 illustrate sconce light fixture apparatus according to one embodiment, including a sconce light fixture 13 and a wall mount bracket 15. The sconce light fixture 13 has a plurality of LEDs mounted therein behind a removable cover 14, which is semicircular in cross-section.

The back side 17 of the illustrative sconce light fixture 13 includes a power supply cover extrusion 19 and upper and lower power supply end caps 21, 23. The upper power supply end cap 21 has first and second hooks 25, 27, which extend vertically parallel to one another. The lower power supply end cap 23 has parallel male electrical connector plugs or pins 29, 31, which project projecting downwardly therefrom, and side guides, e.g., 30, 32 positioned on either side of the pins 29, 31.

In an illustrative embodiment, the wall mount bracket 15 has an upper junction box 33, a lower junction box 35, and a central wire guide 37, which is positioned between the upper and lower junction boxes 33, 35. The upper junction box 33 includes a power feed point 39 and respective tabs 41, 43 on opposite sides 45, 47 thereof. The lower junction box 35 has respective female electrical connector openings or receptacles 50, 52, in a top surface 53 thereof. The receptacles 50, 52 are flanked on either side by first and second openings 49, 51. In the illustrative embodiment, the central wire guide 37 is rectangular in cross-section and has a raised conductor conduit 38 centrally positioned therein.

In the illustrative embodiment, the hooks 25, 27; the pins 29, 31; the side tabs 41, 43; and the receptacles 49, 51 are positioned such that the sconce fixture 13 may be attached to the wall bracket 15 by simply sliding the hooks 25, 27 down over respective side tabs, 41, 43, while at the same time inserting the plugs 29, 31 into the receptacles 49, 51. The side guides (locator pins) 30, 32 on the lower power supply end cap 23 fit into a respective one of the openings 49, 51 to assist in positioning the electrical connector pins 29, 31. In one embodiment, a locking screw may be inserted through the lower junction box 35 and into the locator pin 30.

In the illustrative embodiment of FIG. 1-2, electrical power (e.g. line voltage) is supplied from the power feed point 39 through the conductor conduit 38 to the receptacles 50, 52, then to the pins 29, 31 and from the pins 29, 31, to a suitable driver (power supply) for LED lighting devices. The driver or power supply may be mounted within the power supply cover 19. In one embodiment, the power supply may be a Lutron model L3DA4U1UMN-AV120. In an alternate embodiment, power can be fed into the lower junction box 35 and the electrical leads connected directly to the first and second female power connectors 50, 52.

Figure 15:
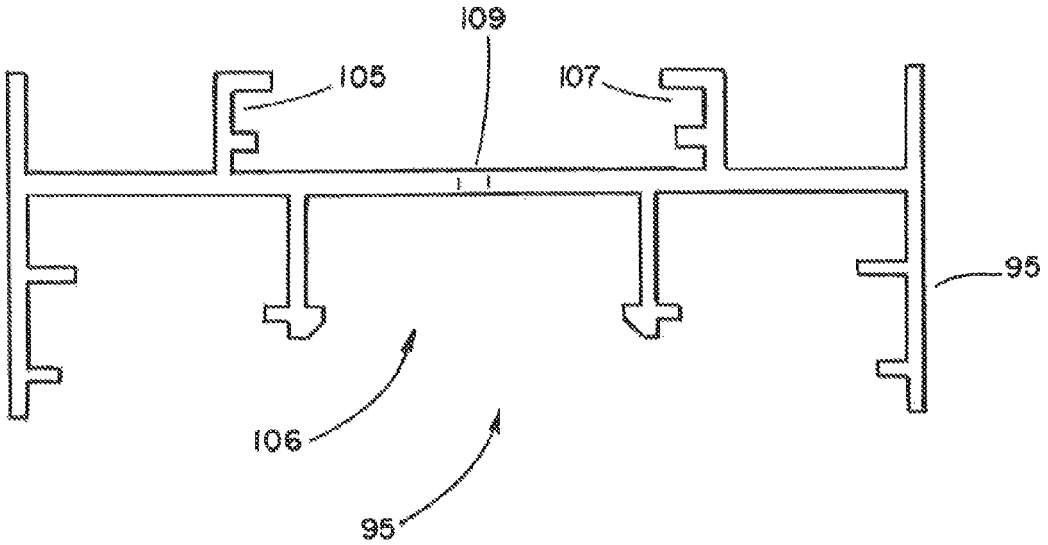
FIG. 15 is an end view of the housing of the sconce fixture of FIGS. 3-5.
Figure 16:
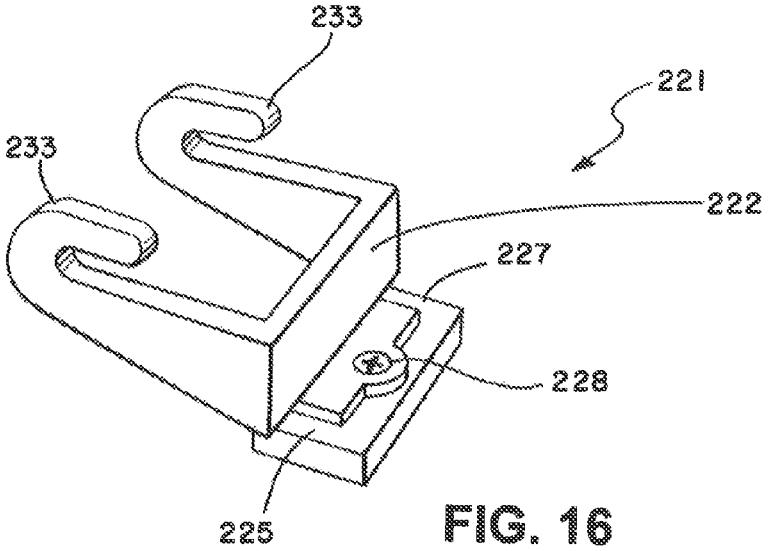
FIG. 16 is a side perspective view of an upper power supply end cap.
Figure 17:
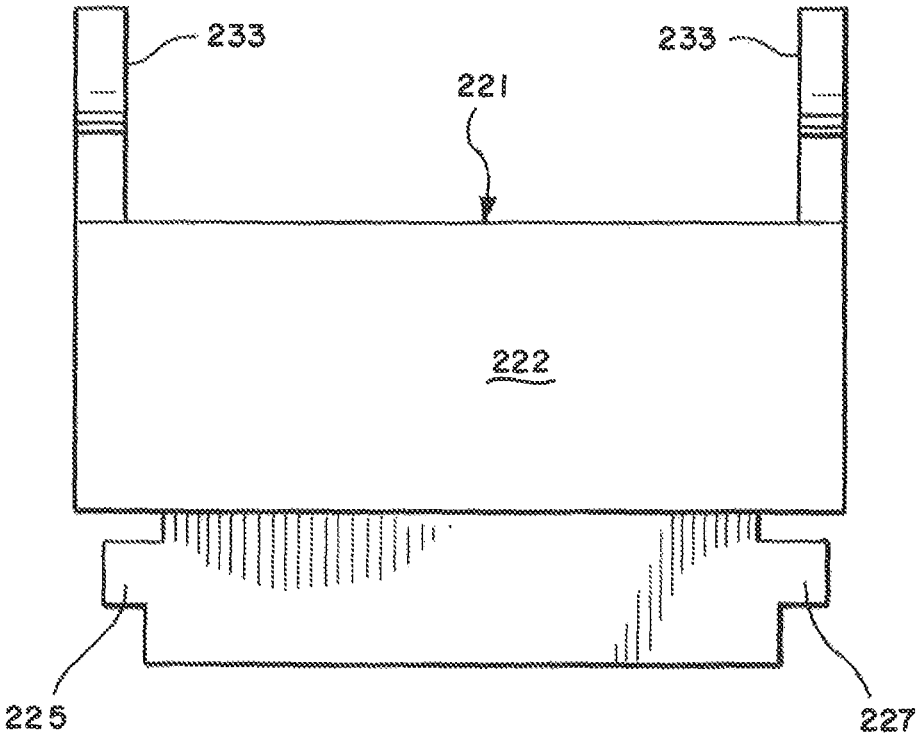
FIG. 17 is an end view of an upper power supply end cap.
Figure 18:
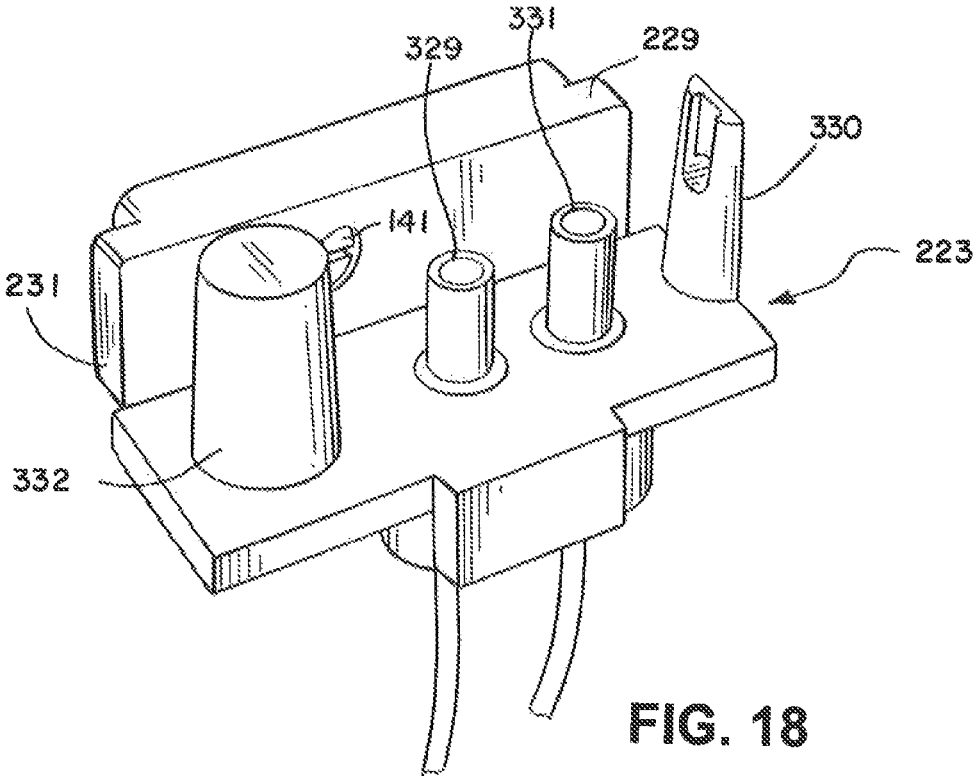
FIG. 18 is a perspective view of a lower power supply end cap.
Figure 19:
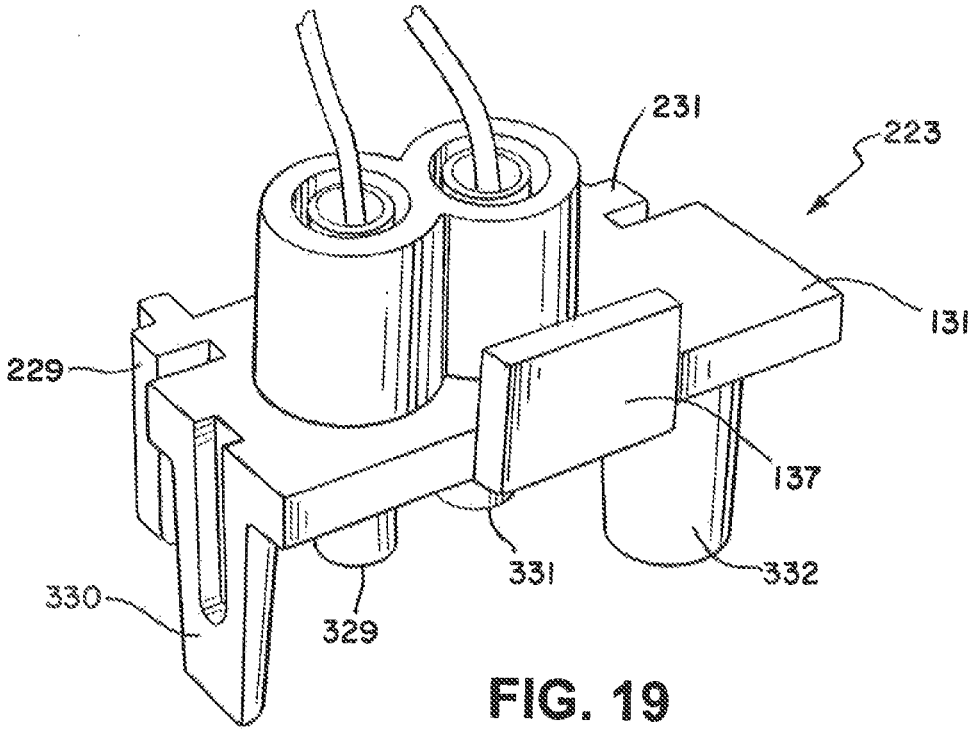
FIG. 19 is a second perspective view of a lower power supply end cap.

An alternate embodiment sconce light fixture 113 is illustrated in FIGS. 3-24. The sconce light fixture 113 includes an upper housing end cap 91 of rectangular cross-section, a lower housing end cap 93 of rectangular cross-section, and a central housing 95 positioned between the upper and lower housing end caps 91, 93. A removable, light transmissive lens cover 96 is positioned on the housing 95 between the housing end caps 91, 93. Behind the lens 96 is a bank of circuit boards 114, each mounting one or more LEDs. The circuit boards 114 may be mounted in a channel 106 formed in the central housing 95 (FIG. 15). In one embodiment, each end cap 91, 93 may have a lightly frosted lens with an LED circuit board located behind the lens in order to provide illumination in the up and down directions.

Figure 3:
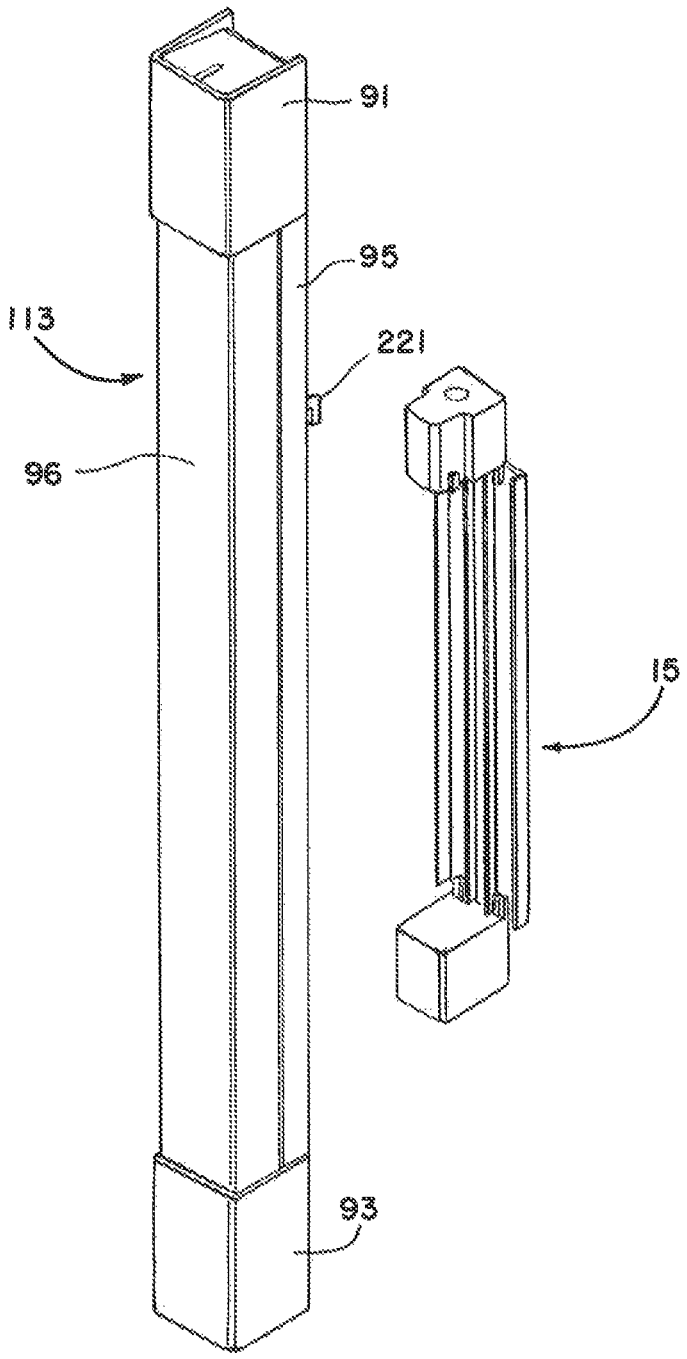
FIG. 3 is a front perspective view of a second illustrative embodiment.

The alternate embodiment of FIG. 3 may employ a wall bracket 15 constructed in the same manner as that employed in the embodiment of FIGS. 1-2, with dimensions adjusted as may be appropriate for the particular application. Further details of an illustrative wall bracket 15 are shown in FIGS. 6-11, which will now be discussed.

Figure 6:
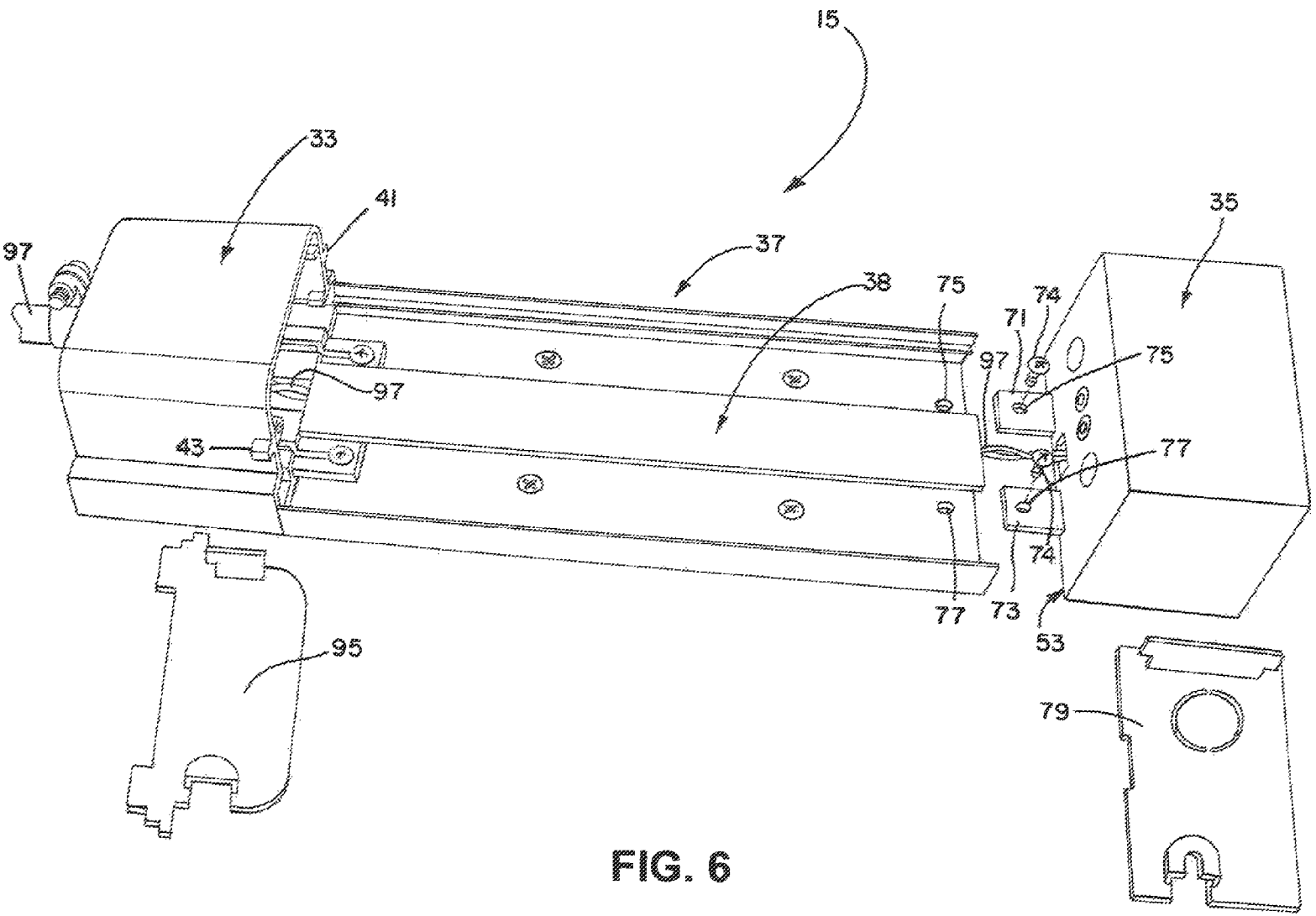
FIG. 6 is a side perspective view of a wall mount bracket according to an illustrative embodiment.
Figure 7:
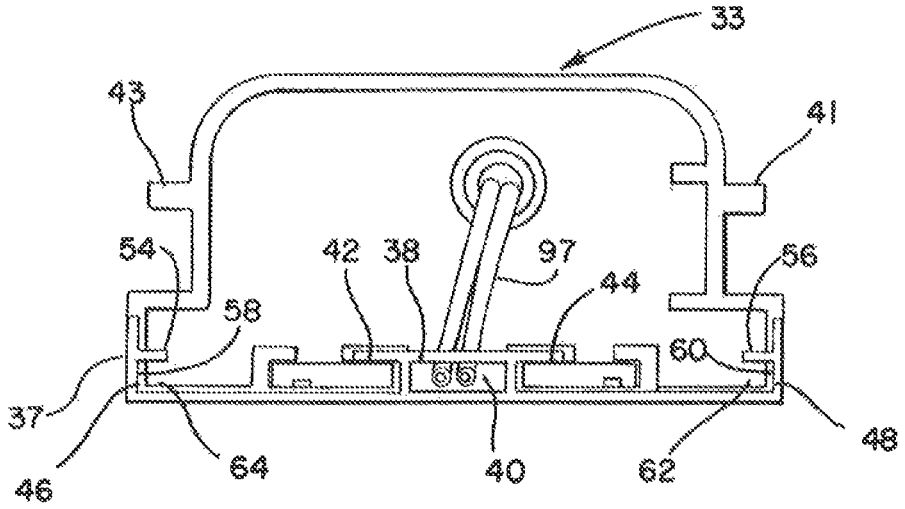
FIG. 7 is an end view of an illustrative upper junction box component of the wall mount bracket of FIG. 6 in assembly with a central wire guide component.
Figure 8:
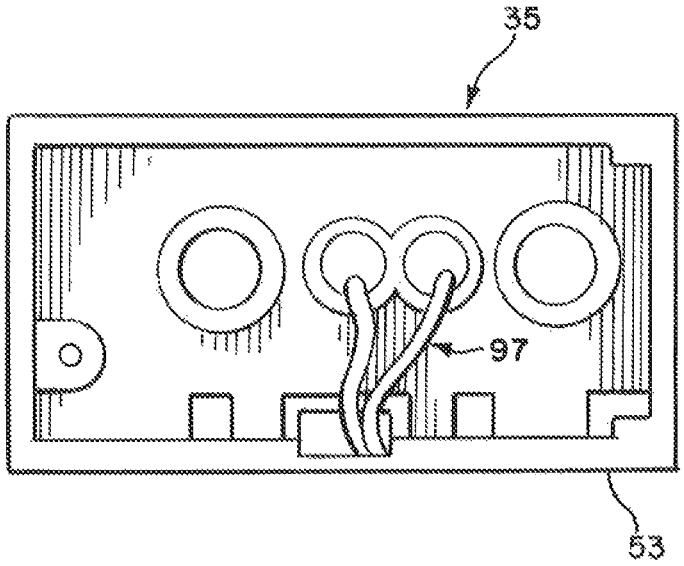
FIG. 8 is an end view of an illustrative lower junction box component of the wall mount bracket of FIG. 7.
Figure 9:
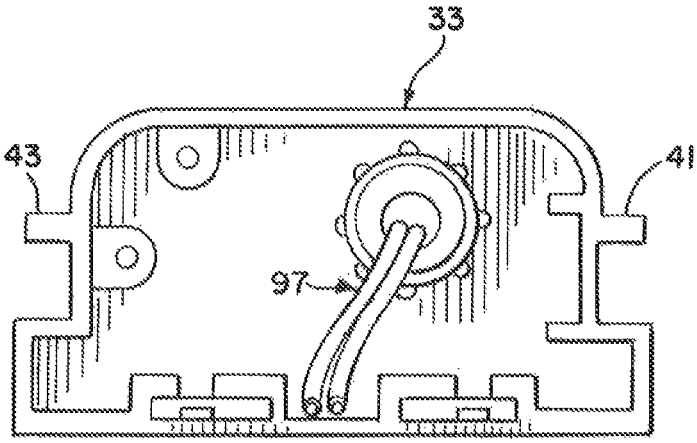
FIG. 9 is an end view of an illustrative upper junction box component of the wall mount bracket of FIG. 8 in assembly with a central wire guide component.

As seen in FIGS. 6 and 7, the back side 53 of the lower junction box 35 of the wall bracket 15 has respective vertically extending tabs 71, 73, which are positioned to slide into the respective slots 42, 44 in the conductor conduit 38, whereafter the lower junction box 35 is fastened in place by screws 74 inserted through respective holes 75, 77 in the wire guide 37. The upper junction box 33 is similarly attached to the wire guide 37.

As seen in the end view of FIG. 7, the conductor conduit 38 has an enclosed central opening 40, which surrounds the electrical cable or conductor 97. The respective vertical sides 46, 48 of the wire guide 37 each have a respective horizontal tab 54, 56 extending from a respective inner side surface 58, 60, which form respective slots 62, 64.

Figure 10:
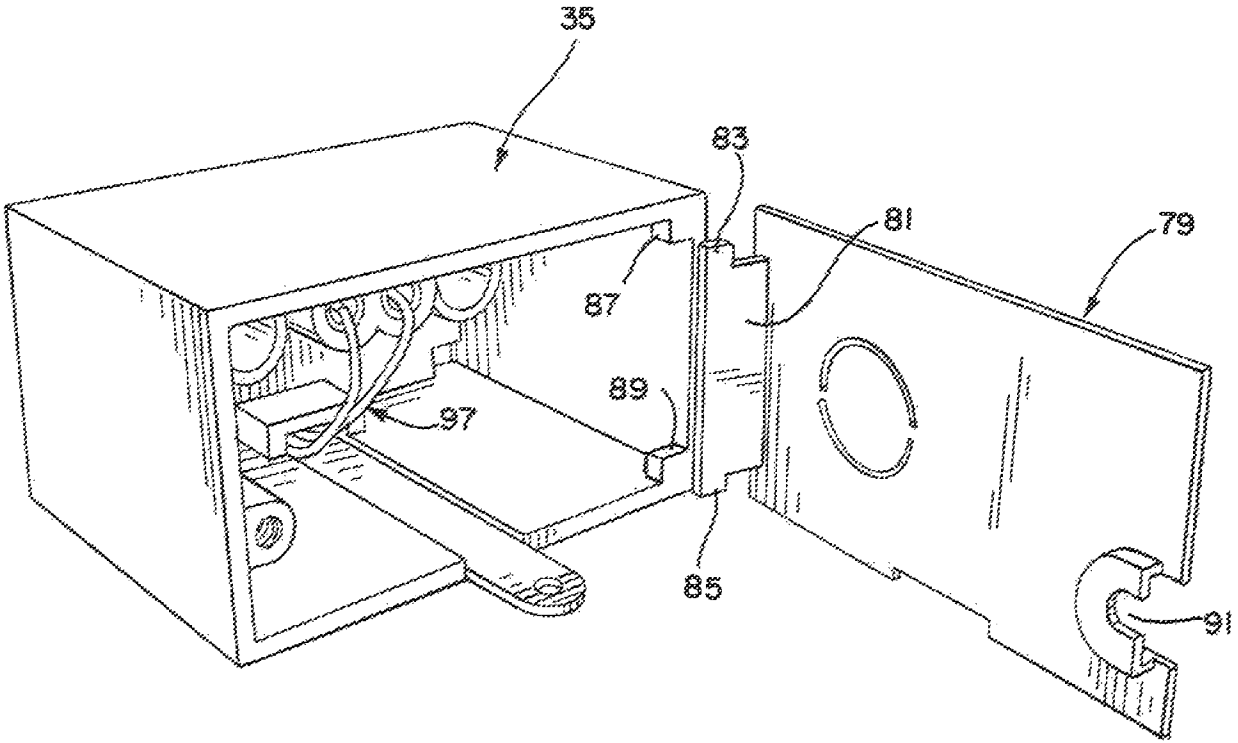
FIG. 10 is a perspective view of the lower junction box component with a cover component thereof in an open position.
Figure 11:
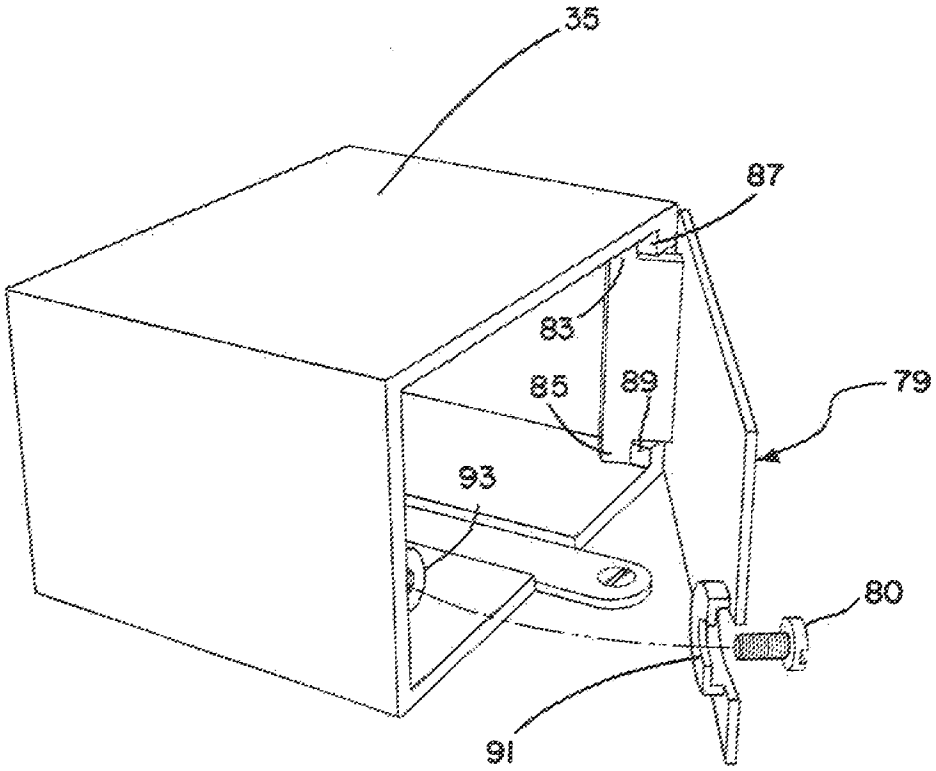
FIG. 11 is a perspective view illustrating closure of the door of FIG. 10.
Figure 12:
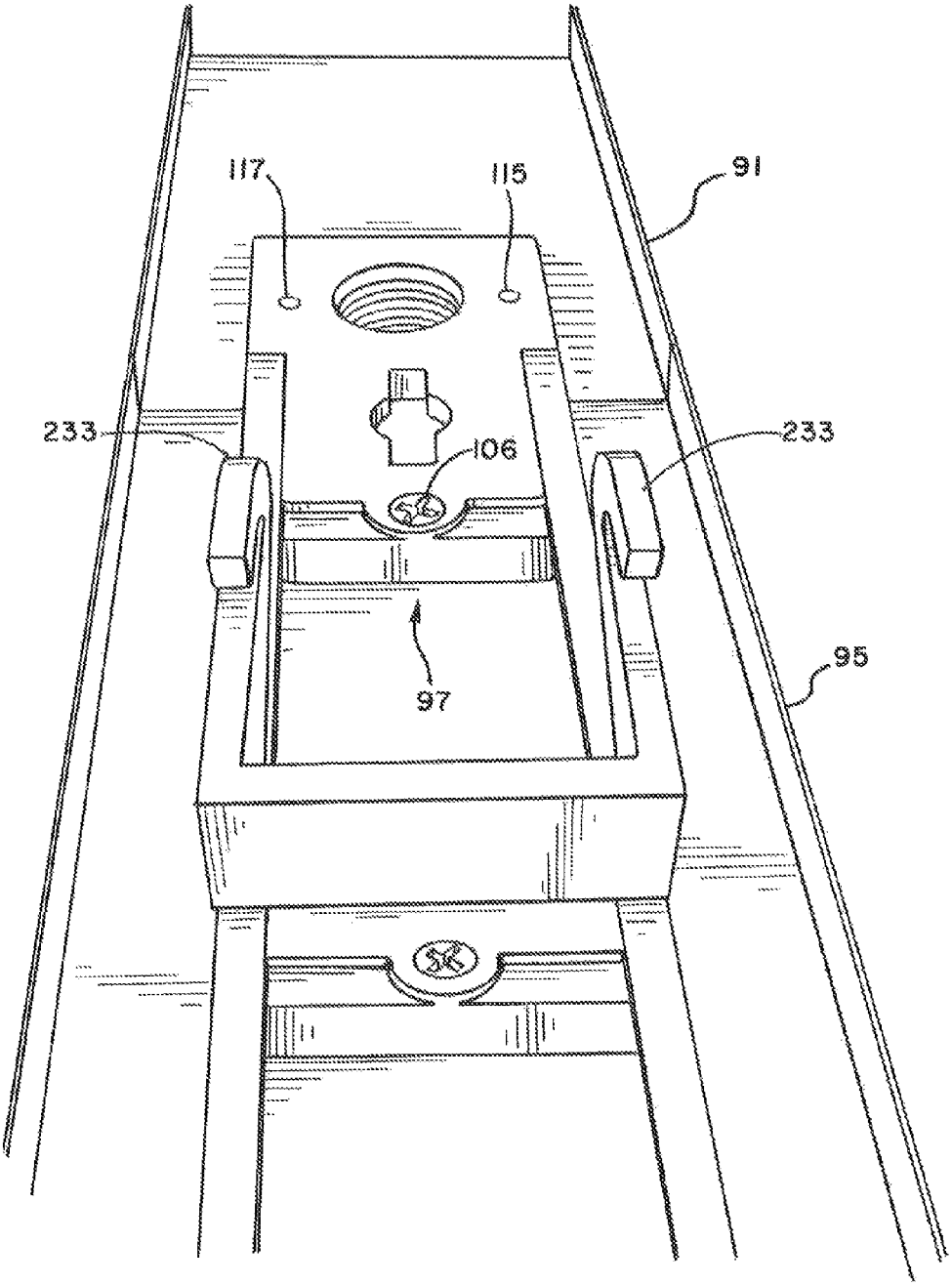
FIG. 12 is a partial perspective view of the rear of a housing component of the embodiment of FIGS. 3-5.
Figure 13:
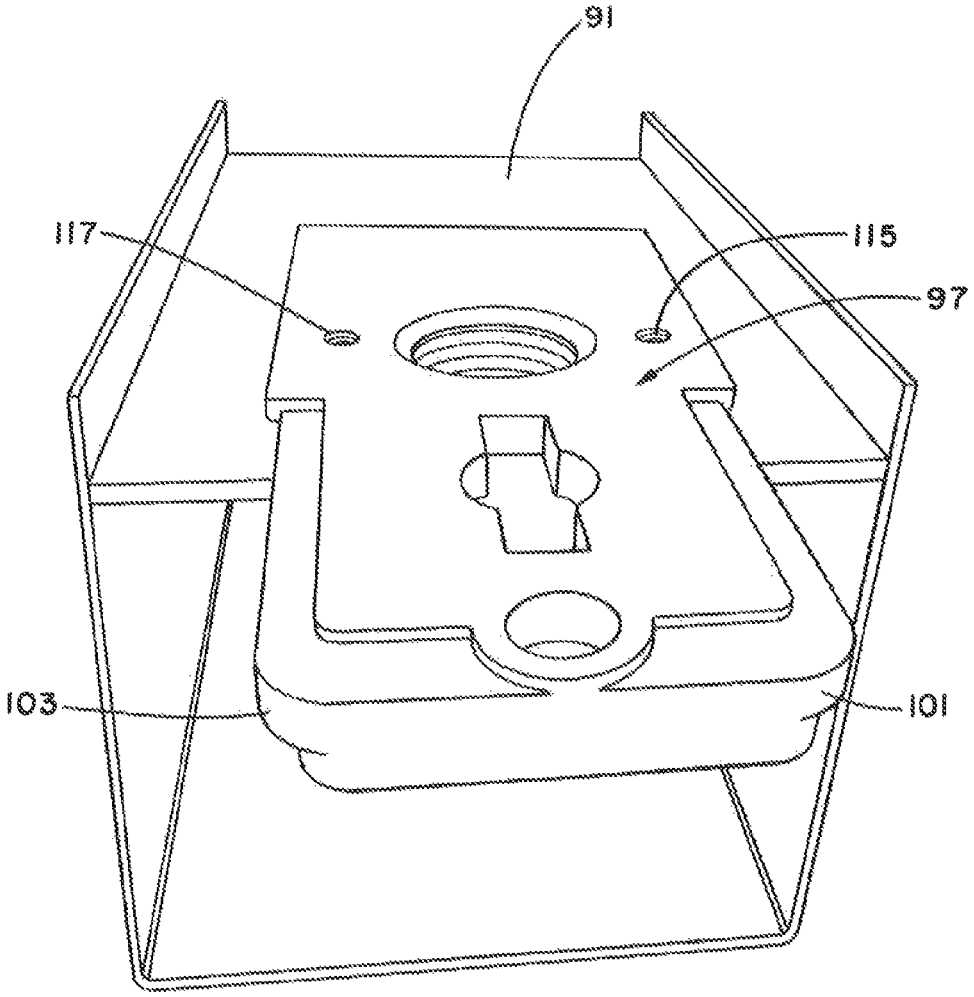
FIG. 13 is a perspective view of a slip fitter component installed in an upper end cap of the sconce fixture of FIGS. 3-5.
Figure 14:
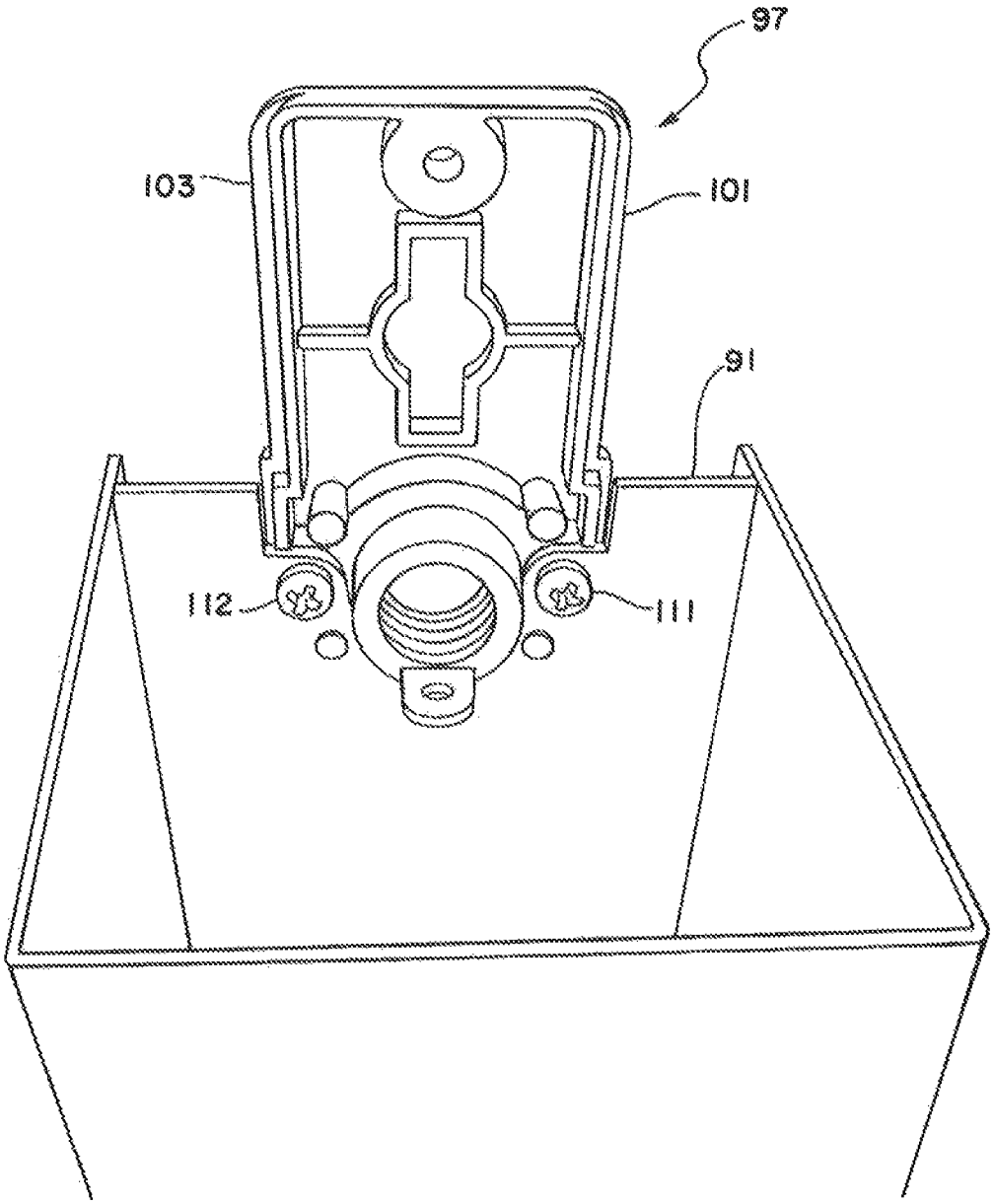
FIG. 14 is a perspective view looking up at the slip fitter component installed in an upper end cap of the sconce fixture of FIGS. 3-5.

In one embodiment, as shown in FIGS. 10 and 11, the lower junction box cover 79 has a tab 81 with respective tangs 83, 85 formed thereon, which fit behind nubs 87, 89 when the cover 79 is inserted sidewardly into the lower junction box 35. The cover 79 is then pivoted into a closed position as illustrated in FIG. 11 and a screw 80 is inserted through an opening 91 and into a boss 93 to fasten the cover 79 in place. In the illustrative embodiment, the upper junction box cover 95 (FIG. 6) is constructed and attached in the same manner as the lower junction box cover 79. As may be seen from FIGS. 6-10, the electrical leads 97 enter the upper junction box 33, enter and pass through the central conduit 37, and exit into the lower junction box 35 where they supply power to the receptacles 50, 52.

Figure 4:
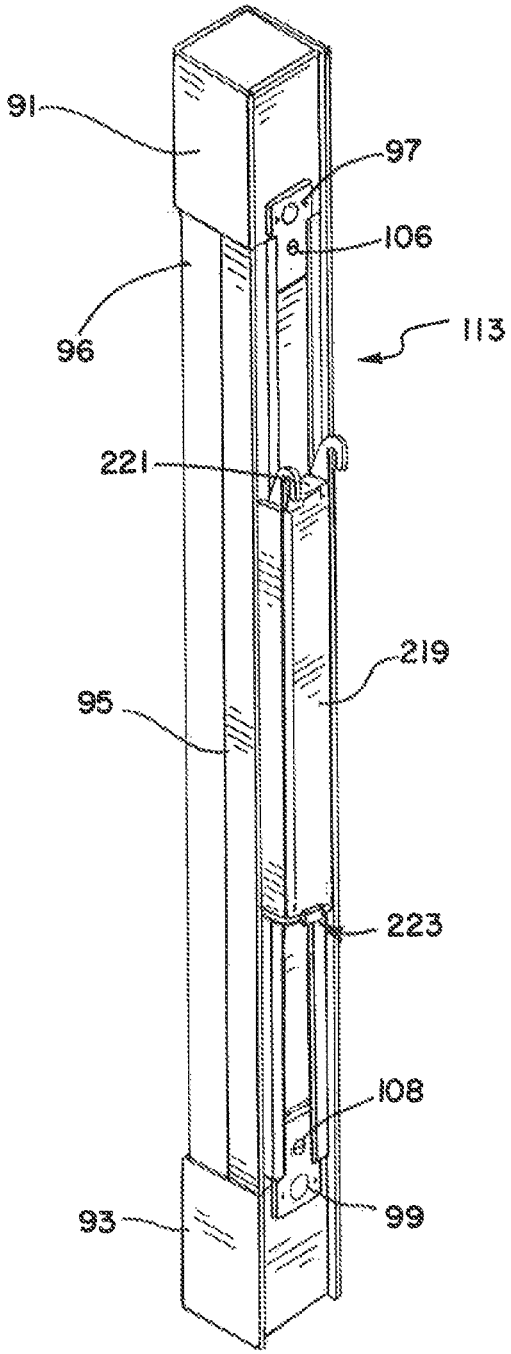
FIG. 4 is a back perspective view of the sconce light fixture of the second illustrative embodiment.
Figure 5:
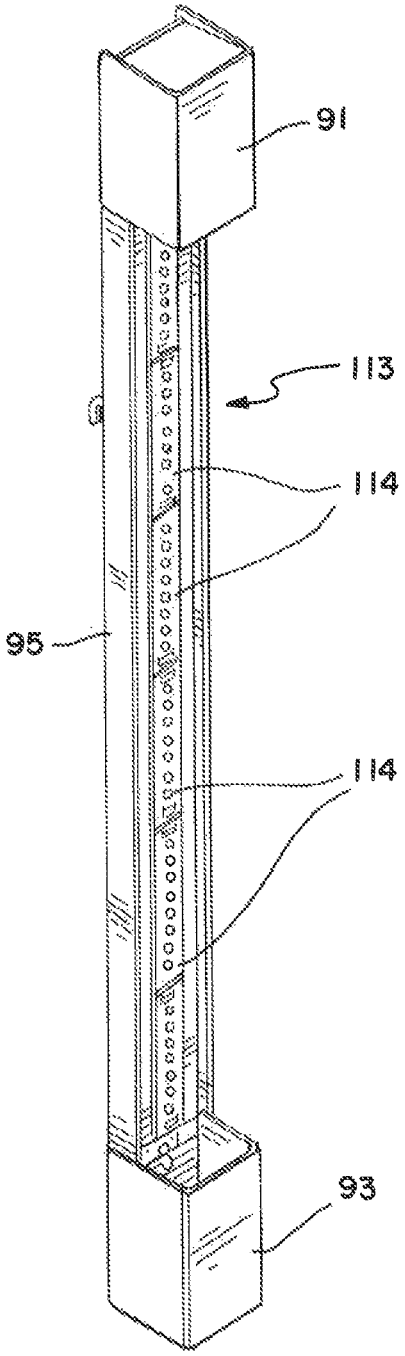
FIG. 5 is a front perspective view of the sconce light fixture of the second illustrative embodiment.

FIGS. 12-15 illustrate the manner in which the housing end caps 91, 93 are attached to the central sconce fixture housing 95 in the embodiment illustrated in FIGS. 3-5. In the illustrative embodiment, the housing end caps 91, 93 are attached to the central housing 95 by respective slip fitter components 97, 99. Each slip fitter 97, 99, has respective side fins 101, 103 which slide into respective slots 105, 107 formed on the back surface 109 of the central housing 95 (FIG. 15), whereafter each slip fitter 97, 99 is fixed in position by respective screws 106, 108. Pairs of screws 111, 113 (FIG. 14) inserted through holes 115, 117 in the underside of each slip fitter 97, 99 complete the interconnection of the respective end caps 91, 93 with the housing 95.

Figure 20:
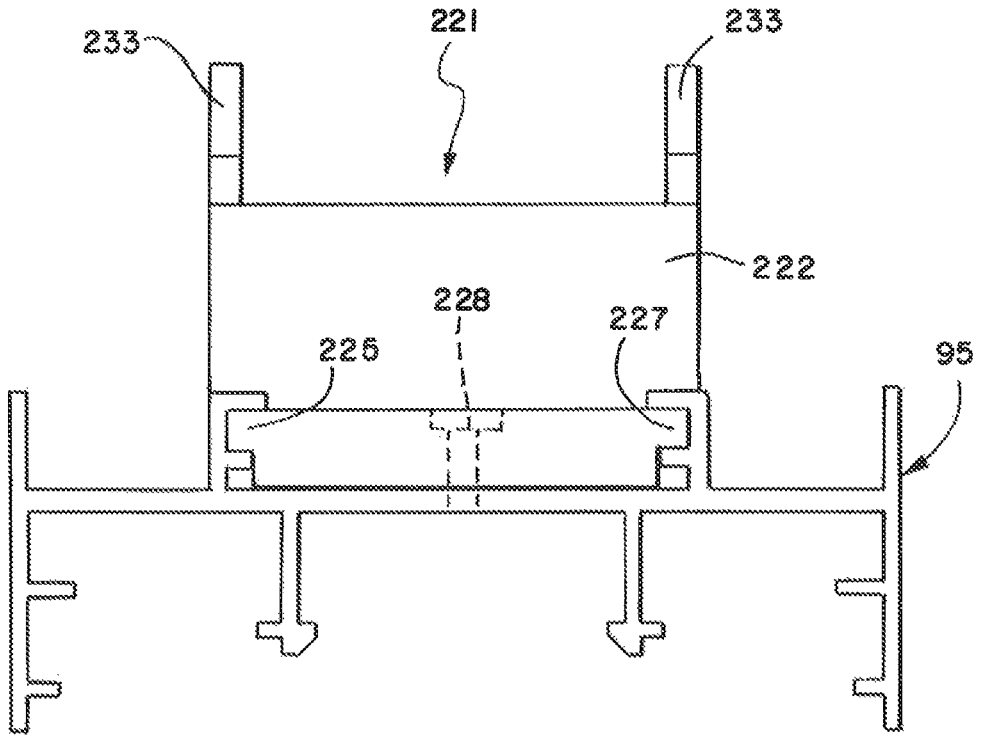
FIG. 20 is an end view of the upper power supply end cap installed in a sconce light fixture central housing.

The embodiment of FIGS. 3-5 employs power supply end caps 221, 223 which may be constructed in the same manner as those of FIG. 1-2. As illustrated in FIGS. 16-19, the power supply end caps 221, 223 each have respective pairs of wings 225, 227; 229, 231 on their side surfaces, which are shaped to slide into the slots 105, 107 on the back surface 109 of the central housing 95 in the same manner as the slip fitter components 97, 99. FIG. 20 illustrates the upper power supply end cap 221 installed in the slots 105, 107 of the central housing 95.

Figure 21:
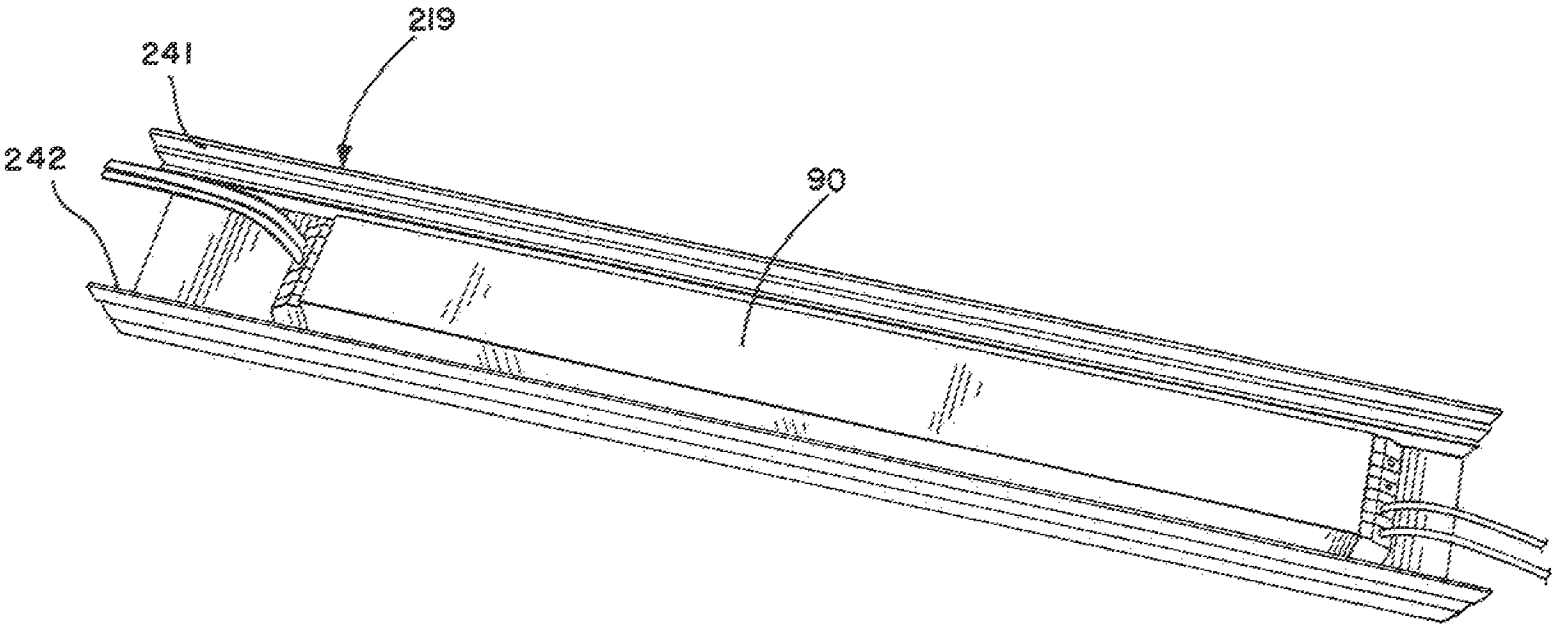
FIG. 21 is a perspective view illustrating a power supply installed in a power supp housing according to illustrative embodiments.

In the embodiment of FIGS. 3-5, as with the embodiment of FIGS. 1-2, a power supply cover 219 is positioned between the power supply end caps 221, 223. In one embodiment, as shown in FIG. 21, a power supply 90 is attached to the inside top surface of the power supply cover 219, for example, by suitable double-sided adhesive tape. In one embodiment, the interior sides 241, 242 of power supply cover 219 are shaped to rest on the central housing surface 109 adjacent the sides of the respective slip fitters 97, 99.

Figure 22:
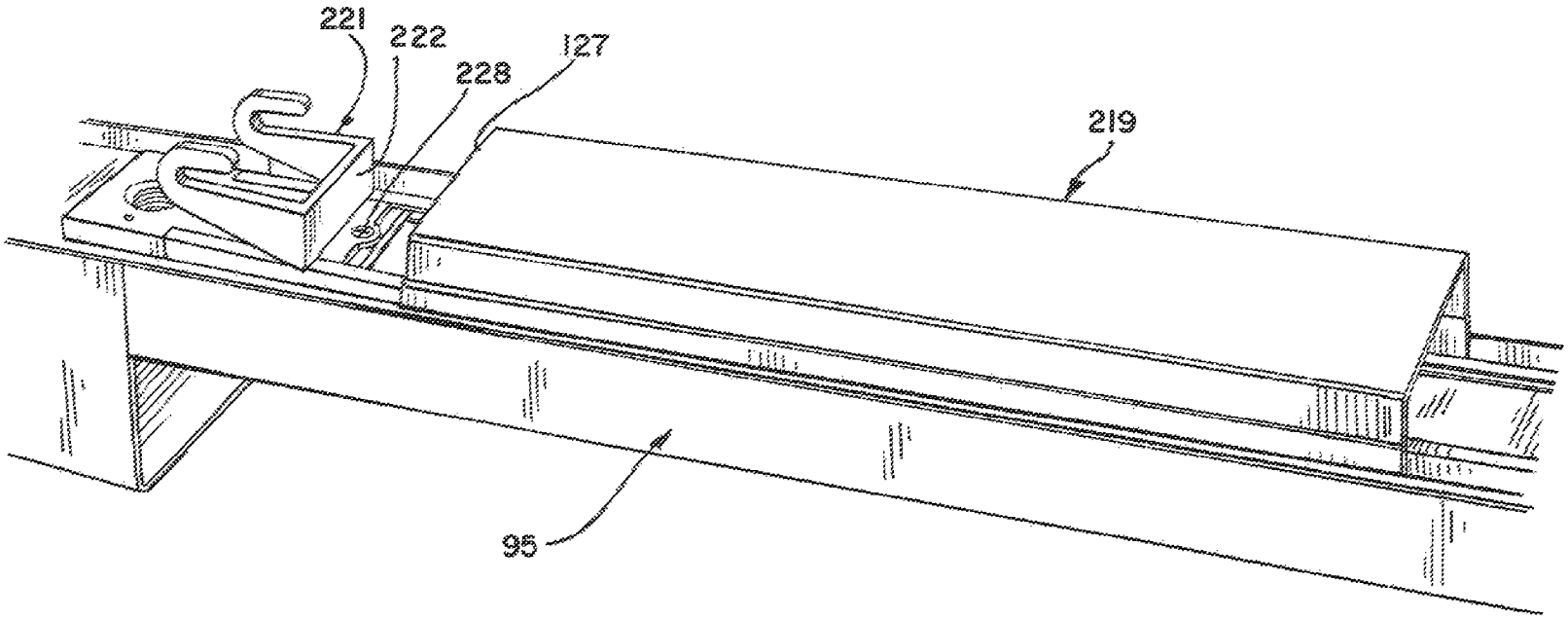
FIG. 22 is a perspective view illustrating installation of an upper end cap and power supply housing onto a sconce light fixture housing of the embodiment of FIGS. 3-5.
Figure 23:
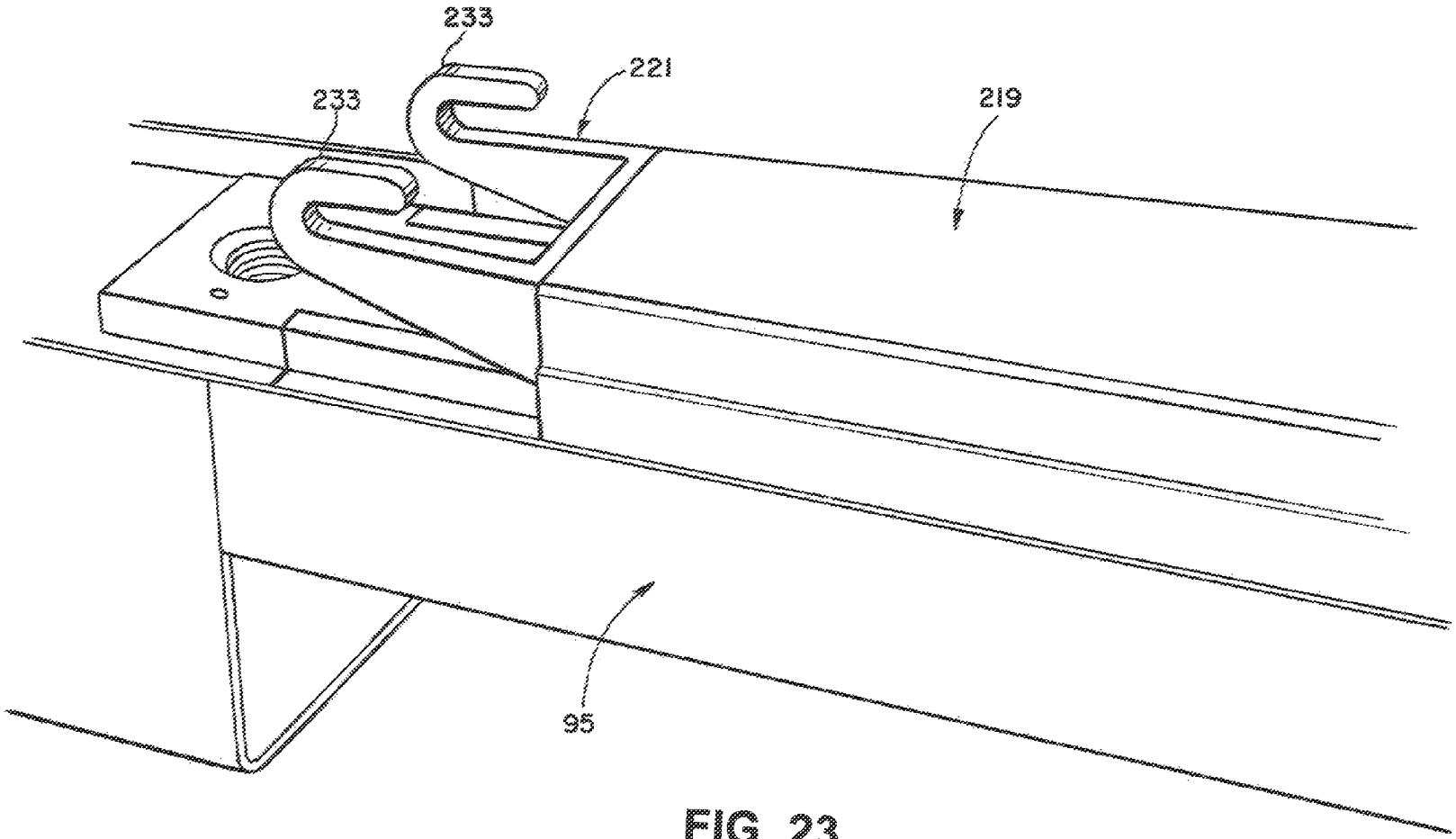
FIG. 23 is a perspective view illustrating installation of an upper end cap and power supply housing onto a sconce light fixture housing of the embodiment of FIGS. 3-5.
Figure 24:
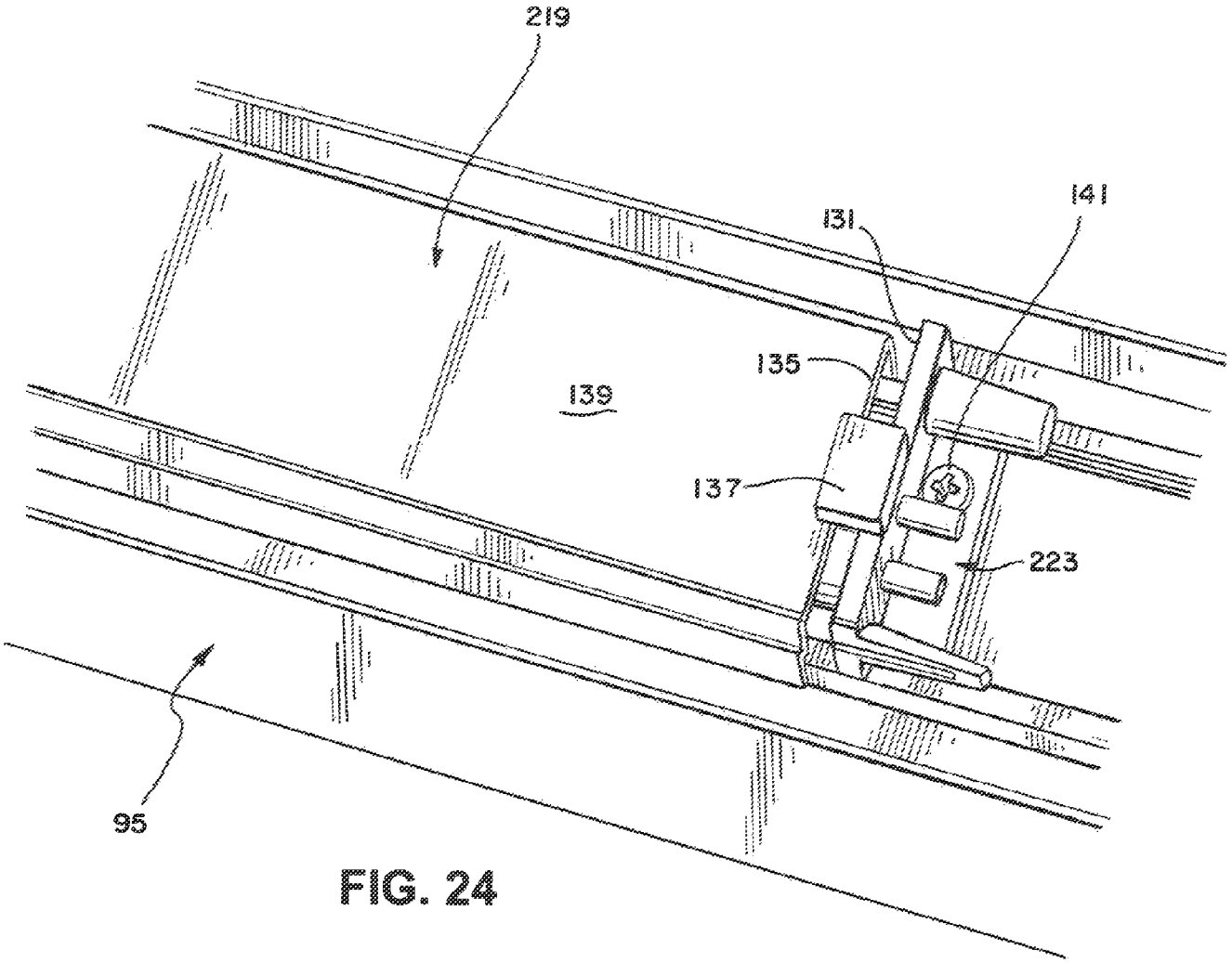
FIG. 24 is a perspective view illustrating installation of a lower end cap into the power supply housing and sconce light fixture housing of the embodiment of FIGS. 3-5.
Figure 25:
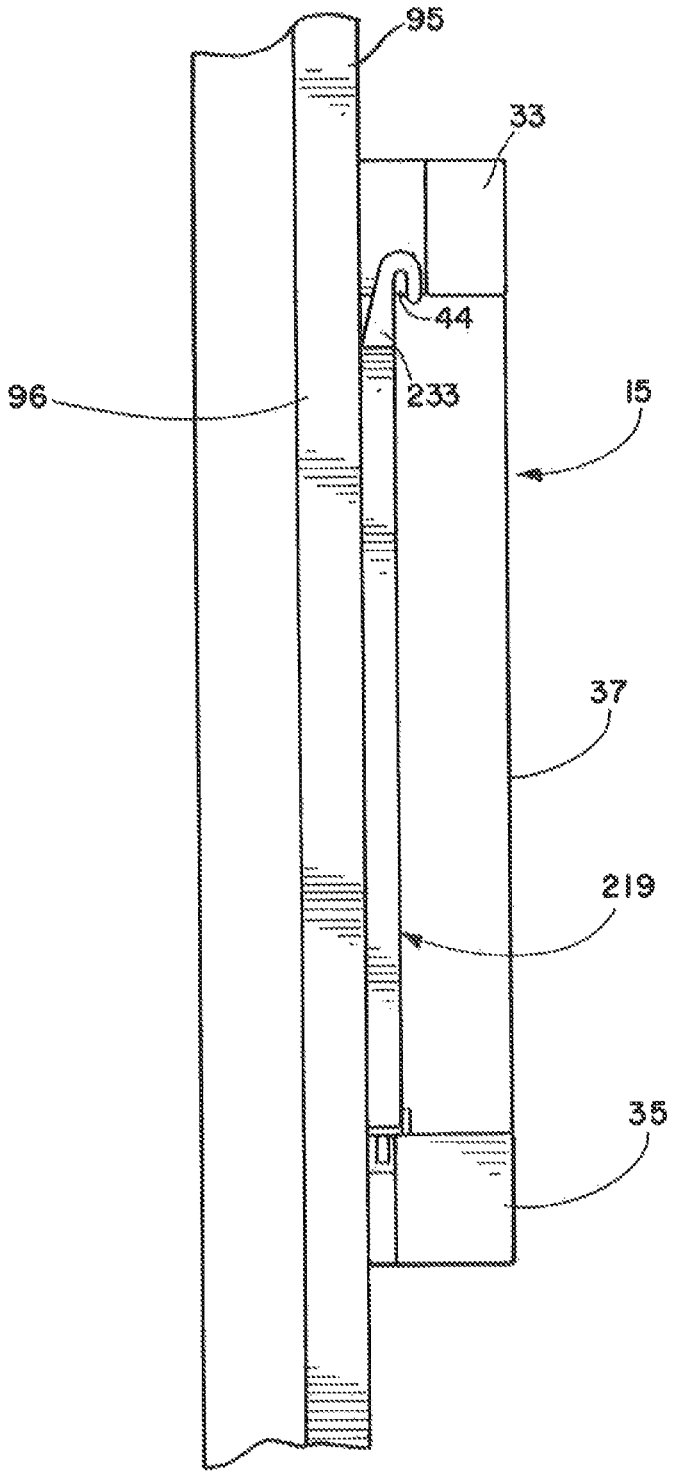
FIG. 25 is a side view of the embodiment of FIGS. 3-5 in the assembled state.

The manner of assembly or installation of the end caps 221, 223, and cover 219 according to an illustrative embodiment is further illustrated in FIGS. 22-24. In assembly, the top power supply end cap 221 is installed in the slots 105, 107 of the central housing 95 and fastened down by its screw 228, as shown in FIG. 22. The power supply cover 217 is then put in place and its upper end 127 is brought into abutting relation with the back surface 222 of the upper end cap 221 (FIG. 23). The back surface 222 is shaped so as to completely close the otherwise open end 127 of the cover 219. As shown in FIG. 24, the lower power supply end cap 223 is then slid into the slots 105, 107, until its back surface 131 abuts and closes the lower end 135 of the power supply cover 219, while a tab 137 slides over and abuts the top surface 139 of the cover 219. A screw 141 is then inserted and tightened down to hold both the cover 219 and lower end cap 223 in place.

In the embodiment of FIGS. 3-5, as with the embodiment of FIGS. 1-2, the hooks 233; the pins 329, 331; the side tabs 41, 43; and the receptacles 49, 51 are positioned such that the sconce fixture 113 may be attached to the wall bracket 15 by simply sliding the hooks 233 down over respective side tabs, 41, 43, while at the same time inserting the pins 329, 331 into the receptacles 49, 51. The side guides 330, 332 on the lower power supply end cap 223 fit into a respective one of the openings 49, 51 to assist in positioning the electrical connector pins 329, 331.

FIGS. 26-30 illustrate an alternate "flush mount" sconce embodiment. This embodiment includes a central housing extrusion 311, a top cap 313, a bottom cap 315, a face plate 317, an LED driver 319, and a junction box 321. The face plate 317 is generally rectangular and shaped to mate with and close the junction box 321, with the exception of the presence of a rectangular opening 323. Inwardly projecting flanges 326, 328 disposed on the vertical edges of the opening 323 position respective oppositely disposed side tabs 341, 343 in the interior of the junction box 321. The lower horizontal edge 342 of the rectangular opening 323 forms one edge of a connector block 335, which has a horizontally-extending shelf 336 formed integrally therewith.

The top cap 313 and bottom cap 315 are constructed in a similar manner to other embodiments, each having a pair of wings 425, 427; 429, 431 on their side surfaces, which are shaped to slide in slots 305, 307 on the back surface 309 of the central housing 311. The top cap 313 further has respective hooks 461, 462 formed thereon, while the bottom cap 315 has a side guide 430, a locator pin 432, and first and second central conductor guides 433, 434 containing respective electrical'pins in their interior, which are configured to deliver power to LEDs within the sconce fixture 301.

Figure 29:
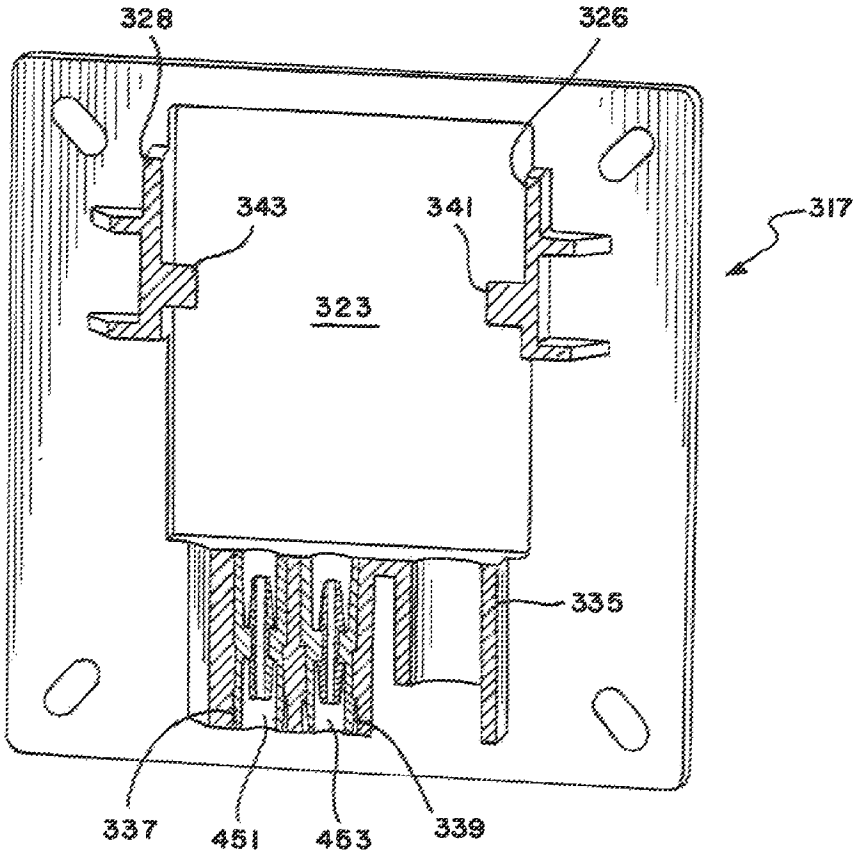
FIG. 29 is a perspective sectional view of the face plate component prior to assembly.
Figure 30:
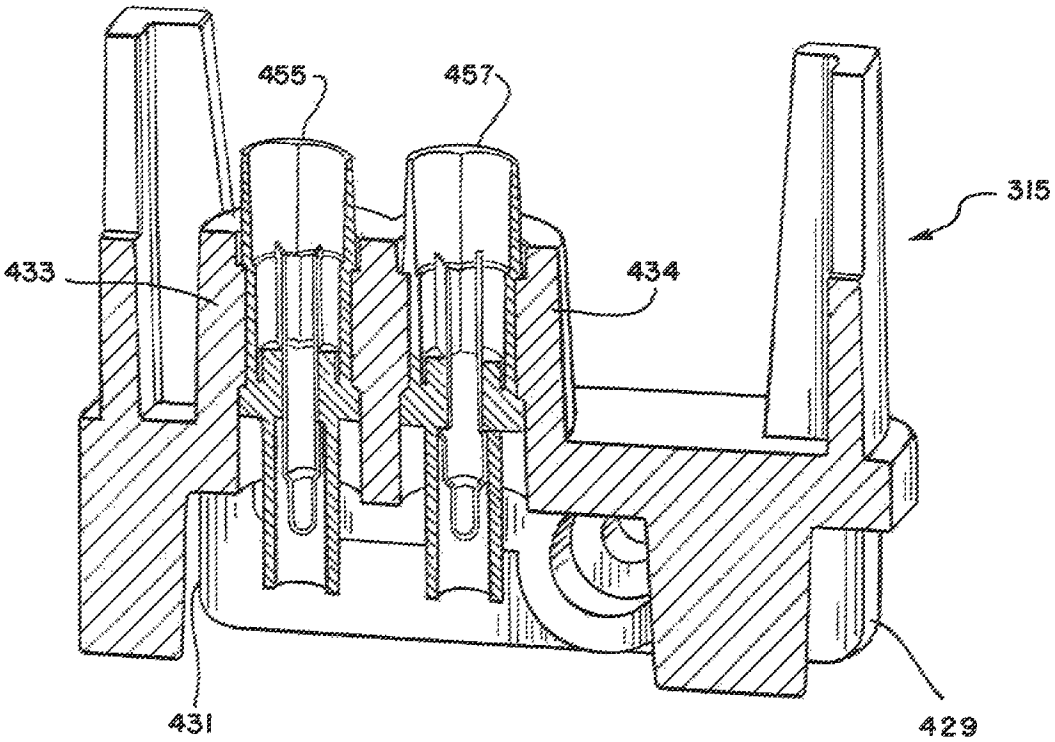
FIG. 30 is a perspective section view of the end cap component of FIG. 26.

FIGS. 29 and 30 illustrate the positioning of female electrical connectors 451, 453 in the receptacles 337, 339 of the face plate 317, and the positioning of respective mating male electrical connectors 455, 457 in the receptacles 422, 434 of the bottom cap 315. In one embodiment, respective electrical leads from the power supply 319 pass under the shelf 336 and mate with the respective male connectors 451, 453. In one embodiment, electrical leads emanate from the tops of connectors 455, 457 and pass through an opening 448 in the surface 309 to supply power to LEDs mounted in circuit boards within the sconce fixture 301.

When assembled, the LED driver 319 is fixed to the shelf 336, for example, by double sided adhesive tape and low-voltage electrical leads emanating from the driver 319 are interconnected with the electrical connectors 451, 453 of the face plate 317 which transfer power into the mating electrical connectors 455, 457, when the bottom cap 315 is inserted through the opening 323 in the face plate 317.

In assembly, in one embodiment, the junction box 321 is first attached to a wall or other surface, and the driver 319 is attached to the shelf 336 with its low voltage leads having been previously interconnected with the connectors 451, 453. Line voltage electrical leads are then connected to the driver 319, and the face plate 317 is then attached to the junction box 321 by screws 353.

To attach the sconce fixture 301 to the junction box 321, the bottom cap 315 is slid into the slots 305, 307 of the central housing 311 and fixed in place, for example, by a suitable screw. The top cap 313 is then slid into the slots 305, 307. The fixture 301 is then positioned such that the locator pin 432 of the bottom cap 315 plugs into an opening or receptacle 340 in the wire guide block 335, the side tab 430 of the bottom cap 315 mates with groove 338 on the connector block 335, and the electrical connectors 451, 453; 455, 457 mate. The top connector 313 is then slid downwardly until the hooks 425, 427 capture the side tabs 341, 343 of the face plate 317. In the illustrative embodiment of FIG. 26, the top cap 313 and bottom cap 315, the hooks 425, 427, the side tab 430, and the locator pin 432 and other components are shaped dimensioned and positioned such that the sconce fixture 301 may be attached to the junction box 321 in the manner just described.

Figure 26:
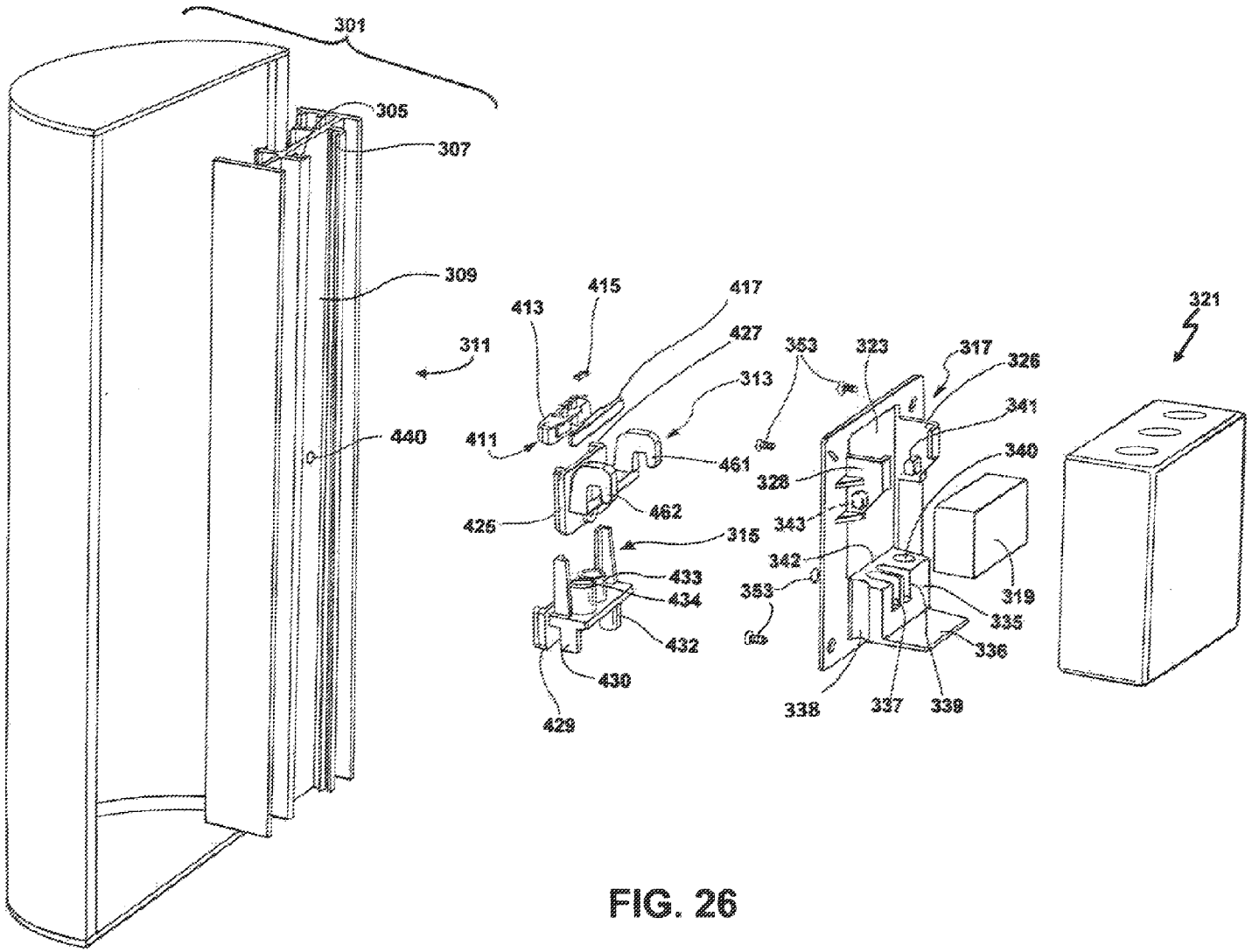
FIG. 26 is a perspective of a third embodiment.
Figure 27:
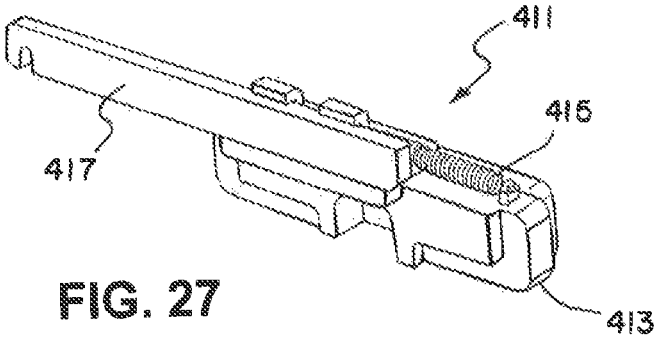
FIG. 27 is a perspective view of a spring loaded latch assembly employable in the third embodiment.
Figure 28:
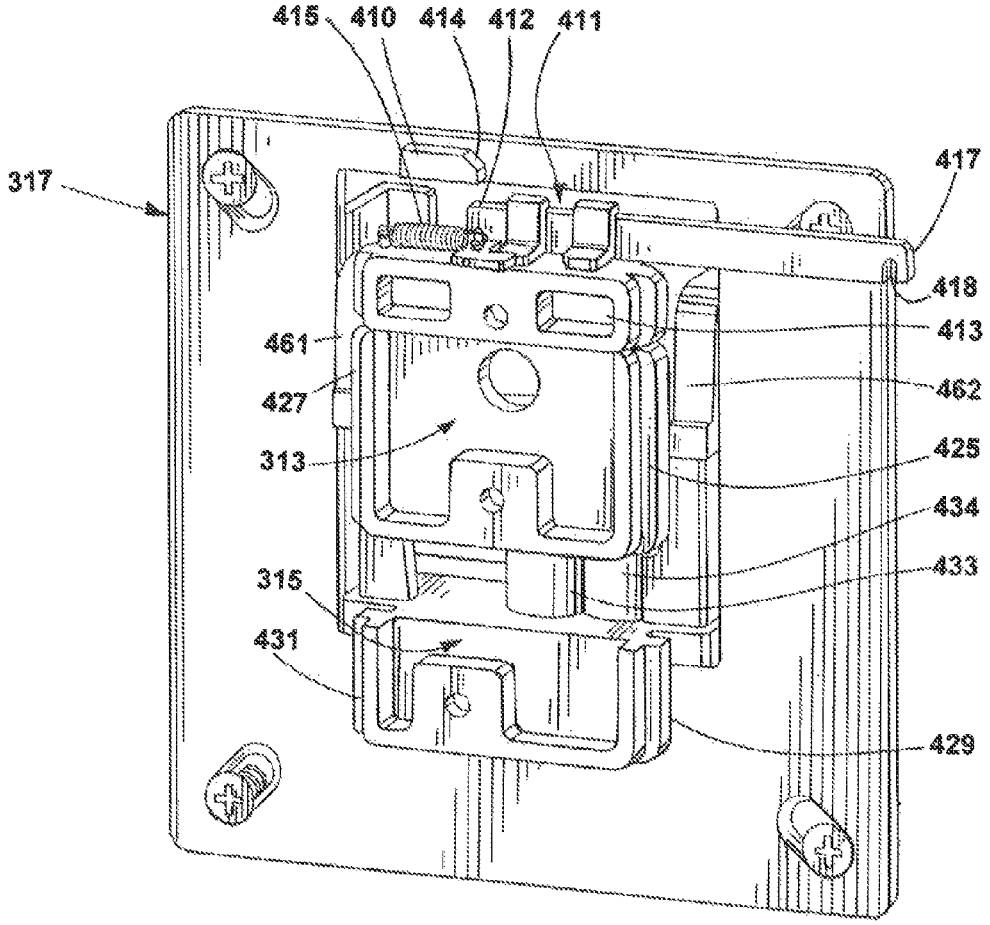
FIG. 28 is a rear perspective view of a face plate component of FIG. 26 with the spring loaded latch assembly in a latched position.

In the illustrative embodiment of FIG. 26, a spring loaded latch assembly 411 may be provided to hold the top cap 313 in place and thus retain the sconce fixture 301 in an attached or assembled position so that it cannot be pulled off the wall. As shown in FIGS. 26-28, the latch assembly 411 includes a latch body 413, a latch spring 415, and a latch release rod 417. Upon insertion of the bottom cap 315 and top cap 313 into the cavity of the junction box 321, a cam surface 414 of the face plate boss 410 comes into mechanical contact with the latch release rod 417 so as to cause lateral displacement of the latch release rod 417, creating tension in the spring 415. When full insertion is achieved, the latch release rod 417 returns to its previous position where it now lies beneath the boss 410. FIG. 28 illustrates the latch release rod 417 in this final or assembled position where its right end 412 is positioned beneath the boss 410 at a slight distance from the boss, of, for example, ⅛ inch. In such position, the end 412 will come into abutment with the boss 410 if upward movement of the sconce fixture 301 occurs. If it is desired to disassemble the unit, the release rod 417 is pulled to the right in FIG. 28, so that its end 412 can pass by the boss 410 without contacting it. An indentation 418 may be provided in the latch rod 417 to enable insertion of a screwdriver or other tool to assist in pushing the release rod 417 to the right.

Figure 31:
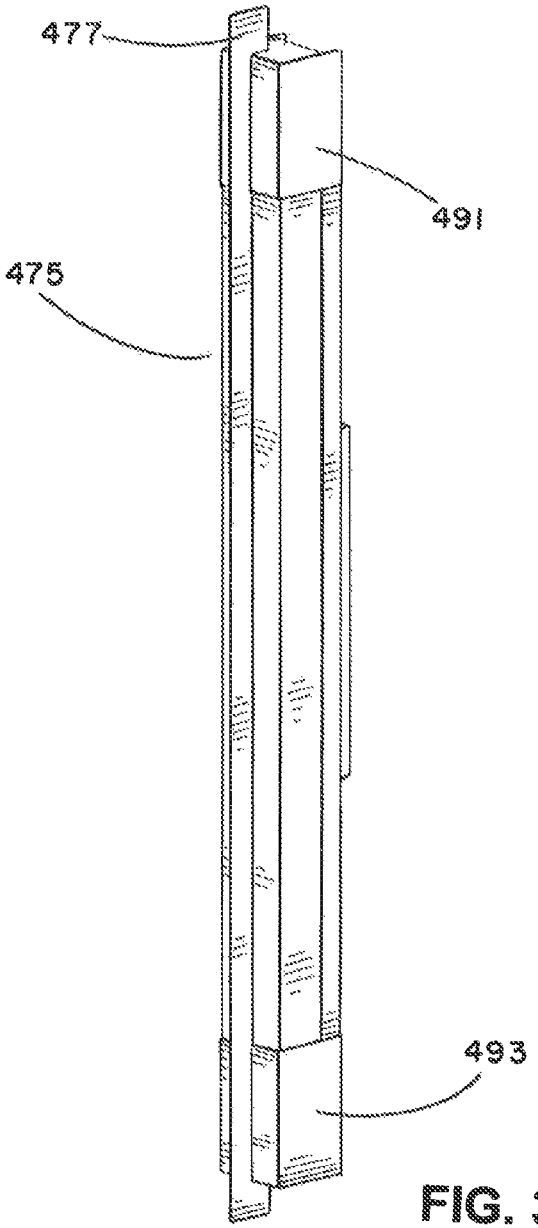
FIG. 31 is a perspective view of an illustrative generally rectangular sconce fixture embodiment.
Figure 32:
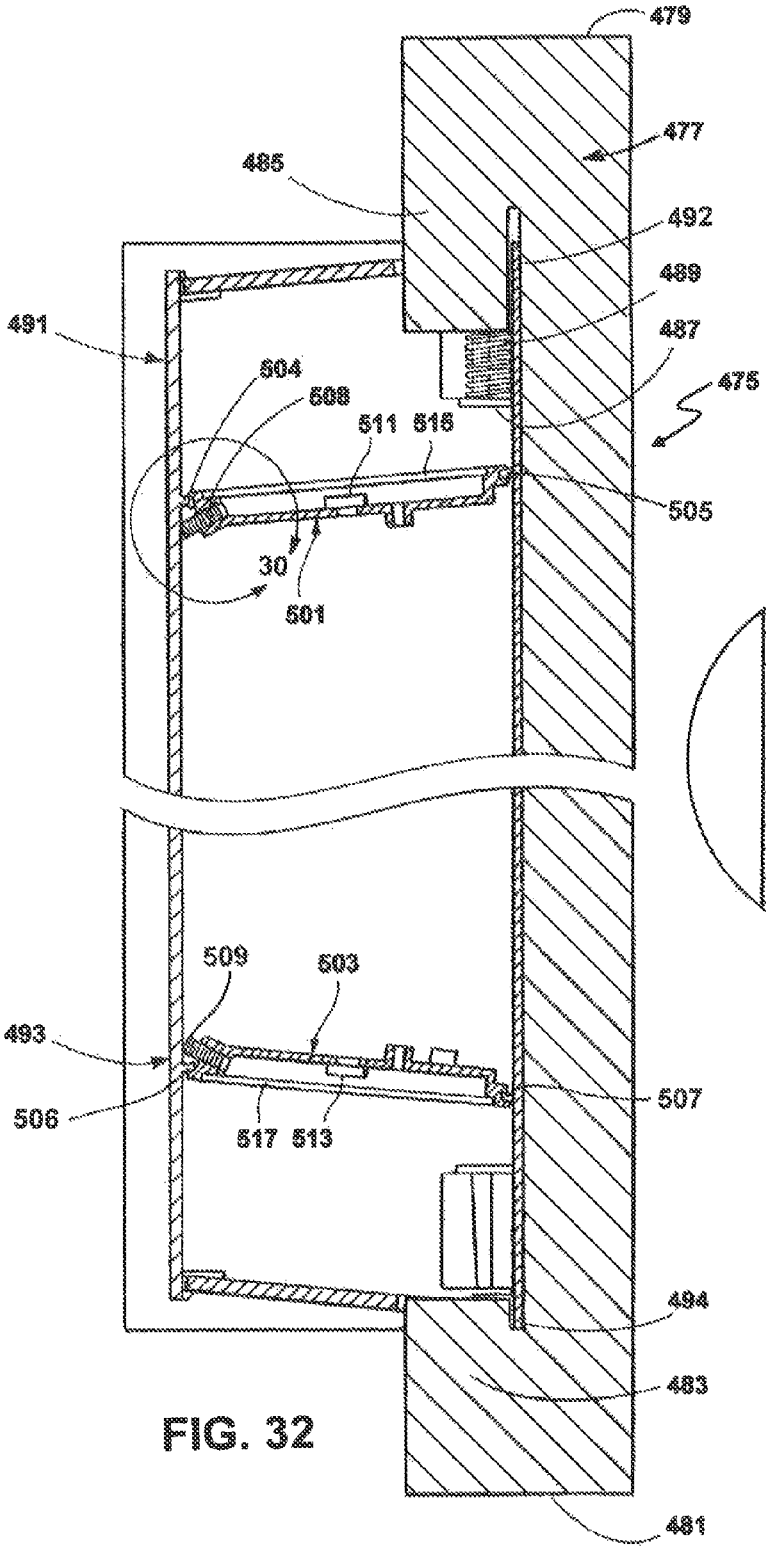
FIG. 32 is a partial side sectional view of the embodiment of FIG. 31.
Figure 33:
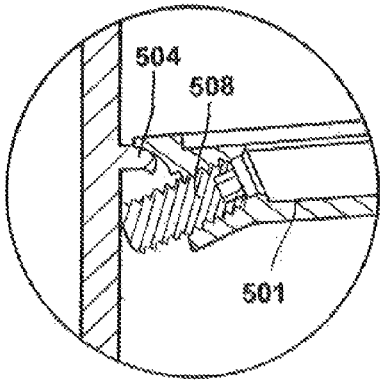
FIG. 33 is a detail taken at "30" of FIG. 32.

FIGS. 31-33 illustrate a rectangular sconce fixture embodiment 475 employing a centrally positioned vertical decorative strip 477. As illustrated in FIGS. 28-30, the apparatus is configured such that the upper and lower ends 479, 481 of the decorative strip 477 fit into vertical slots in the respective upper and lower housing end caps 491, 493 and such that hook portions 483, 485 hook over the front surfaces 492, 494 of those ends caps 491, 493. A horizontal mounting pad 487 extends from the inner wall of the upper end cap 491 on which is mounted a compression spring 489. In one embodiment, the compression spring 489 may be retained within a chamber which has a vertical slot permitting the upper end 485 of the decorative strip 477 to ride up and down against the bias of the spring 489.

In the illustrative embodiment of FIGS. 31-33, the lower end 483 of the decorative strip 477 is shorter than the upper end 485. During installation, the upper end 485 of the decorative strip 477 is positioned and pressed down against the spring 489 to full compression. Then the lower end 483 is first hooked over the edge of the front surface 494 of the lower housing end cap 493, and the strip 477 will then be in a position. Where the spring 489 is compressed, while simultaneously having hooks portions 483 and 485 located behind front surfaces 492 and 494. In one embodiment, the spring 489 is at 50% compression when the strip 477 is completely installed. This mechanism enables easy and positive attachment of a wide range of decorative strips or other items after installation of the entire rectangular sconce fixture 475.

FIG. 32 further illustrates mounting of upwardly and downwardly facing LED circuit boards 501, 503 in the upper and lower housing end caps 491, 493. As shown, the boards 501, 503 may be held in position by side tabs 504, 505; 506, 507 and additionally retained by set screws 508, 509. The boards 501, 503 mount one or more LEDs, e.g. 511, 513, beneath light transmissive lens covers 515, 517, which may be snap-fitted or otherwise attached in place.

One advantage realizable with the illustrative embodiments is that a wall mount bracket component, e.g. 15, may be installed at a relatively early stage of construction of a theatre or other structure, and the relatively expensive sconce light fixture 13 may then be installed at a later stage of construction when the risk of damage to the fixture is reduced.

Thus, those skilled in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. A light fixture apparatus comprising:

a sconce light fixture comprising a housing;

first and second hooks mounted on a back side of the housing;

first and second downwardly disposed electrical conductor pins mounted on said back side;

a wall mount bracket configured to be attachable to a wall and having first and second tabs positioned on respective side surfaces of a top portion thereof and first and second female electrical connector receptacles positioned in a lower portion thereof, wherein the first and second hooks, first and second electrical conductor pins, first and second side tabs, and first and second female electrical connector receptacles are so shaped, dimensioned and positioned that the sconce light fixture is mountable to the wall mount bracket by sliding the first and second hooks respectively down over the first and second side tabs, while at the same time inserting the first and second electrical conductor pins respectively into the first and second electrical female connector receptacles.

2. The light fixture apparatus of claim 1 further comprising a power supply cover and wherein said first and second hooks are mounted on a first power supply end cap positioned adjacent a first end of said power supply cover and said first and second electrical conductor pins are mounted on a second power supply end cap positioned adjacent a lower end of said power supply cover.

3. The light fixture apparatus of claim 1 wherein said wall mount bracket comprises a wire guide mounted between the upper and lower junction boxes, the wire guide having a closed central conduit running between said upper and lower junction boxes.

4. The light fixture apparatus of claim 1 wherein said sconce light fixture further comprises first and second housing end caps attached to respective upper and lower ends of said housing.

5. The light fixture apparatus of claim 1 wherein said first and second tabs are positioned on respective side surfaces of an upper junction box.

6. The light fixture apparatus of claim 1 wherein the first and second female connector receptacles are positioned in a top horizontal surface of a lower junction box.

7. The light fixture apparatus of claim 2 wherein the first and second power supply end caps are each fastened to a back surface of the housing of said sconce light fixture and wherein said second power supply end cap is configured to retain said power supply cover in position contacting said back surface.

8. The light fixture apparatus of claim 3 wherein said upper junction box is configured to receive an electrical power cable and said central conduit is configured to conduct the power cable to the lower junction box.

9. The light fixture apparatus of claim 6 wherein the first and second female connector receptacles are positioned in a top horizontal surface of a lower junction box.

10. The light fixture apparatus of claim 7 wherein said power supply cover has a rectangular cross-section and wherein said first and second power supply end caps are shaped to close respective rectangular openings at upper and lower ends of said power supply cover.

11. The light fixture apparatus of claim 7 wherein said sconce light fixture further comprises first and second housing end caps attached to respective upper and lower ends of said housing.

12. The light fixture apparatus of claim 8 wherein leads of said power cable are attached to the first and second female connector receptacles.

13. The light fixture apparatus of claim 11 further comprises a light transmissive lens mounted to a front side of said housing between said first and second housing end caps.

14. The light fixture apparatus of claim 13 further comprises a plurality of LEDs mounted within said housing between said first and second housing end caps and positioned to transmit light through said light transmissive lens.

* * * * *